US010016079B2

(12) United States Patent
Chiang et al.

(10) Patent No.: US 10,016,079 B2
(45) **Date of Patent: *Jul. 10, 2018**

(54) CONTAINER AND CONTAINER LID

(71) Applicants: Charles N. Chiang, Monterey Park, CA (US); Benjamin H. Chiang, Monterey Park, CA (US)

(72) Inventors: Charles N. Chiang, Monterey Park, CA (US); Benjamin H. Chiang, Monterey Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/169,678

(22) Filed: May 31, 2016

(65) Prior Publication Data

US 2016/0270573 A1 Sep. 22, 2016

Related U.S. Application Data

(60) Continuation-in-part of application No. 14/289,625, filed on May 28, 2014, now Pat. No. 9,387,966, (Continued)

(51) Int. Cl.
*B65D 55/16* (2006.01)
*A47G 19/22* (2006.01)
(Continued)

(52) U.S. Cl.
CPC ..... *A47G 19/2272* (2013.01); *B65D 43/02* (2013.01); *B65D 43/0212* (2013.01); *B65D 47/0857* (2013.01); *B65D 47/32* (2013.01); *A47G 19/22* (2013.01); *B65D 39/00* (2013.01); *B65D 41/32* (2013.01); *B65D 41/46* (2013.01); *B65D 51/18* (2013.01); *B65D 55/16* (2013.01); *B65D 2205/025* (2013.01); *B65D 2543/00046* (2013.01)

(58) Field of Classification Search
CPC ..... B65D 41/46; B65D 41/32; B65D 51/18; B65D 39/00; B65D 55/16; B65D 43/02; B65D 43/0212; B65D 47/0857; B65D 47/32; B65D 2543/00046; B65D 2205/025; A47G 19/22; A47G 19/2272
USPC .... 220/254.3, 281, 379, 713, 719, 789, 791, 220/793, 254.7, 266, 375, 731; 229/404, 229/906.1
See application file for complete search history.

(56) References Cited

U.S. PATENT DOCUMENTS

RE20,057 E * 8/1936 Alexander ..... B65D 7/04 220/624
8,851,325 B1 * 10/2014 Chiang ..... A47G 19/2272 220/254.3
(Continued)

*Primary Examiner* — J. Gregory Pickett
*Assistant Examiner* — Elizabeth Volz
(74) *Attorney, Agent, or Firm* — Raymond Y. Chan; David and Raymond Patent Firm

(57) ABSTRACT

A lid structure is arranged for detachably coupled at a container body to enclose a container cavity thereof, wherein the lid structure includes a container lid and a protective component. The container lid has a drinking hole and an expansion membrane for creating a negative pressure within the container body when the container lid is sealed at the container body. The protective member has a fixed end extended from the container lid and a sealed end detachably engaged with the drinking hole to seal the drinking hole for prevent liquid spilling from the container cavity.

18 Claims, 36 Drawing Sheets

Related U.S. Application Data which is a division of application No. 13/987,188, filed on Jul. 8, 2013, now Pat. No. 8,851,325.

(51) Int. Cl.

| | |
|---|---|
| ***B65D 43/02*** | (2006.01) |
| ***B65D 47/08*** | (2006.01) |
| ***B65D 47/32*** | (2006.01) |
| *B65D 41/32* | (2006.01) |
| *B65D 41/46* | (2006.01) |
| *B65D 51/18* | (2006.01) |
| *B65D 39/00* | (2006.01) |

(56) References Cited

U.S. PATENT DOCUMENTS

| | | | | |
|---|---|---|---|---|
| 9,387,966 | B2 * | 7/2016 | Chiang | A47G 19/2272 |
| 2006/0266755 | A1 * | 11/2006 | Hollis | B29C 63/06 220/703 |

* cited by examiner

CONTAINER AND CONTAINER LID

CROSS REFERENCE OF RELATED APPLICATION

This is a Continuation in Part application that claims the benefit of priority under 35 U.S.C. § 119 to a non-provisional application, application Ser. No. 14/289,625, filed May 28, 2014, which is a Divisional application that claims the benefit of priority under 35 U.S.C. § 119 to a non-provisional application, application Ser. No. 13/987,188, filed Jul. 8, 2013, which is now U.S. Pat. No. 8,851,325.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a food and beverage container, and more particularly relates to a beverage container with a container lid, which provides a spill proof ability to prevent any beverage leak especially when the disposable container is tipped.

Description of Related Arts

In modern society, with lifestyle changing, hot drinks become popular among people. Everyone has the experience of drinking hot drinks in the leisure afternoon, when walking, shopping or chatting with friends. A hot drink not only can quench one's thirst, but also is good for stomach.

But as the popularity of the hot drinks, followed with the problems of hot drink containers and container lids. Conventionally, people use a container for hot drinks, such as a cup, then use a container lid to cover the opening. A conventional disposable lid of a disposable beverage cup on the current market, which is usually made of plastic, typically has a drinking hole arranged for a user to drink the beverage in the disposable beverage cup, and a vent hole that allows air venting into the disposable beverage cup therethrough for maintaining the balance of the pressure between the inside and outside of the disposable beverage cup. In other words, the air vent is set to maintaining the balance of the pressure between the inside and outside of the container, preventing the high inside pressure to burst. However, the conventional lid has several drawbacks.

A major drawback of the conventional lid is that the conventional lid provides a relatively weak sealing and leak proof ability. In other words, the disposable beverage cup with the conventional lid is inconvenient for carrying. Most of lids in the current market have exposed drinking holes and vent holes.

Since the size of the drinking hole is larger than the size of vent hole, the beverage in the disposable beverage cup will be spilled out through the drinking hole when the disposable beverage cup is tipped. Accordingly, the beverage in the disposable beverage cup may be spilled onto a table, a floor, clothes, file documents, or inside a car, resulting in unnecessary trouble and loss. Worse yet, if the beverage is hot, consumer may get seriously burnt.

The drinking hole allows people to drink the beverage inside the container. People can directly drink from the drinking hole, or by using a straw through the drinking hole. In either way, the drinking hole cover needs to be removed. The closure material usually is disposable, once removed cannot be closed again. If people want to take away the remaining half of the beverage, the beverage will leak from the drinking hole. Moreover, once the container is tilted or put upside down, liquid would leak from the air vent, scalding people and staining items, which is inconvenient to carry. Thus, the conventional design of container lids is not suitable to take away. An improved lid may further comprise a valve only provided at the drinking hole. However, the structure of the valve is complicated which will highly increase the manufacturing cost of the lid. In fact, none of the existing lid provides any seal to seal the vent hole of the lid.

Another problem is that the conventional containers for hot drinks are usually plastic, which can be used to contain coffee, juice or other hot beverages. However, with high temperature of the hot beverages, when the container is covered with container lid, the expanded internal air will rip off the container lid and apart the lid and the container. Sometimes one user need to repeatedly seal the container, which in inconvenient.

Furthermore, since the consumer must pay more attention on carefully holding the disposable beverage cup, he or she may loss focus on other things, which may cause potential hazard. For example, when the consumer carefully holds the disposable beverage cup during driving, he or she may loss focus on driving which may cause accident. Since the beverage is easy to leak out, some people may even pour out the beverage onto a road, or discard the disposable beverage cup onto a green area aside a road or a lawn of a front yard of a house and polluting our environment.

In order to make hot drinks container easy to carry, an improvement of conventional container and container lid are urgently needed to prevent beverages from leaking.

Another solution found in some fast-food restaurants or beverage shops is to provide a beverage tray which is made of cardboard for retaining the disposable beverage cup at the upright position. A beverage tray can typically hold four to six disposable beverage cups. It will be a waste when the customer only buys one or two disposable beverage cups but the seller still has to supply an oversized tray. It will increase the cost and produce additional trashes and possibly environment pollution.

In addition, after a customer choosing hot drinks, shop staff such as a barista or a cashier will get the hot drinks and seal the cup using a cup lid with their hands to prevent drinks from spilling out and to make it easier for customer to drink. In the process that the staff sealing the cup with the cup lid, their hands will directly touch the drinking hole on the lid and area around. And this action will bring bacteria to the drinking hole. When customers using the drinking hole to drink hot drinks, it is inevitably their mouths will in contact with the drinking hole or the area around the drinking hole. Thus, bacteria will be drank together with beverage, which is insanitary and could be dangerous to customers. The staff keeps repeat receiving money, looking for changes, where the money and changes are contaminated with a lot of bacteria and viruses, eventually the staff will inadvertently transmit these bacteria and viruses to different customers which can lead to cross-infection and disease. This is a public health and safety issue needed to be solved.

SUMMARY OF THE PRESENT INVENTION

The main object of the present invention is to provide a beverage container and a container lid, which provides a spill proof ability to prevent any beverage leak especially when the beverage container is tipped.

Another object of the present invention is to provide a beverage container and a container lid, wherein at least one protecting component is provided, where the protecting component further comprises a plug which can be inserted into air vent and drinking hole and can be opened or closed timely.

Another object of the present invention is to provide a beverage container and a container lid, where the lid is thermal expandable. The expansion of the container lid will produce negative pressure inside the container to prevent the liquid from leaking, which will make it more convenient and secure to carry.

Another object of the present invention is to provide a beverage container and a container lid, wherein the container lid is made of thermally expandable material. When the container is expanded, the pressure inside the container is reduced which can prevent the lid shift caused by sudden excessive pressure when cover the container with lid, such that the container is firmly sealed.

Another object of the present invention is to provide a beverage container and a container lid, wherein the container lid uses multi-layer structure to improve the insulation effect.

Another object of the present invention is to provide a beverage container and a container lid, wherein the plug of the air vent and the drinking hole is integrally formed with the container lid, which simplify the manufacturing process.

Another object of the present invention is to provide a beverage container and a container lid, wherein the protecting plug and the container lid are movably connected, and the plug can be easily rotated to any position.

Another object of the present invention is to provide a beverage container and a container lid, wherein the protecting plug can be easily attached to anywhere on the container.

Another object of the present invention is to provide a beverage container and a container lid, wherein a dedicated restraint slot or a positioning groove is provided on the container lid to place the plug in case of loss. It will not interfere with use, but with a better appearance.

Another object of the present invention is to provide a beverage container and a container lid, wherein the container lid is provided with a protective cover which covers the drinking hole together with the surrounding area, prevents the drinking hole be contaminated by bacteria when touched by working stuff and overcomes the cross-infection problem to protect the customer.

Another object of the present invention is to provide a beverage container and a container lid, wherein a protecting cover is provided outside the container lid which is able to seal the drinking hole, to prevent leakage of beverage, and to make the container easy to carry.

Another object of the present invention is to provide a beverage container and a container lid, wherein at least one operating portion is provided on the container lid or the protecting component, which is used to connect the plug and the drinking hole, such that the drinking hole is easier to open and also protected from contamination.

Another object of the present invention is to provide a beverage container and a container lid, wherein the container lid uses a gyro-shaped structure which will expand and form a large receiving space, increasing the internal container body with better decompression effect.

Another object of the present invention is to provide a beverage container and a container lid, which is inexpensive, simple to manufacture and easy to use.

Another object of the present invention is to provide a beverage container and a container lid, which comprises a drinking hole plug adapted to be torn off from a lid cover in order to detachably engage with and sealed at the drinking hole for preventing beverage in the container being leaked from the drinking hole.

Another object of the present invention is to provide a beverage container and a container lid, which contains a drinking plug pit to temporally hold the drinking hole plug after the drinking hole plug is detached from the lid cover.

Another object of the present invention is to provide a beverage container and a container lid, which comprises a vent plug adapted to be torn off from a lid cover in order to detachably engage with and sealed at the air vent. Therefore, the drinking hole and the air vent are completely sealed by the drinking hole plug and vent plug respectively to prevent any leaking and external substance, such as dirt, entering into the container. On the other hand, the drinking hole plug and vent plug can be easily removed from the drinking hole and the air vent respectively.

Another object of the present invention is to provide a beverage container and a container lid, wherein at least one expansion membrane is provided at a lateral side and/or a top side of the lid, so that when the disposable beverage cup is reversed, the expansion of the expansion member will produce negative pressure within the disposable beverage cup, so that beverage leakage is prevented.

Another object of the present invention is to provide a beverage container and a container lid, wherein the lid covers can be packed and stacked together to save the packaging space of the present invention.

Another object of the present invention is to provide a beverage container and a container lid, which does not require to alter the original structural design of the disposable beverage cup, so as to minimize the manufacturing cost of the disposable beverage cup incorporating with the lid of the present invention.

Another object of the present invention is to provide a beverage container and a container lid, wherein no expensive or complicated structure is required to employ in the present invention in order to achieve the above mentioned objects. Therefore, the present invention successfully provides an economic and efficient solution for providing a sealing arrangement and configuration for the disposable beverage cup.

Additional advantages and features of the invention will become apparent from the description which follows, and may be realized by means of the instrumentalities and combinations particular point out in the appended claims.

According to the present invention, the foregoing and other objects and advantages are attained by a beverage container lid which is adapted to a container body, forming a container for liquid, wherein the container lid provided a drinking hole, further comprises:

One protecting component, the protective component further comprises a first protective member, wherein the first protective member comprises a first sealed end. The first sealed end is adapted to the drinking hole, thus the drinking hole is sealed with the first sealed end to preventing liquid leakage from the container.

The container lid further comprises an air vent. The protective component further comprises a second protective member. The second protective member comprises a second fixed end a second sealed end, wherein the second protective member is connected to the container lid through the second fixed end, and the second sealed end is adapted to the air vent to seal the air vent and prevent liquid leakage from the container body.

According to an embodiment of the present invention, the first protective member further comprises a first fixed end, wherein the first protective member is fixedly connected to the container lid.

According to an embodiment of the present invention, the first protective member further comprises a first fixed end, wherein the first protective member is rotatably connected to the container lid through the first fixed end.

According to an embodiment of the present invention, the first protective member further comprises a first fixed end, wherein the first fixed end and the second fixed end are all adhesive, such that the first protective member and the second protective member detachably connected to the container lid, which is able to adhere to any portion of the container lid.

Preferably, the first protective member further comprises an operating portion which is provided at one end of the first protective member. By operate the operation portion to separate the first sealed end and the drinking hole.

According to an embodiment of the present invention, the container lid provided a restraint slot, wherein the restraint slot is adapted to the first seal end to accept the first sealed end and position the first protective member.

According to an embodiment of the present invention, the first sealed end is a plug to seal the drinking hole and the restraint slot.

According to an embodiment of the present invention, the first sealed end having a recess for receiving the peripheral wall of the drinking hole, thereby sealing the drinking hole.

According to an embodiment of the present invention, the container lid further comprises an expandable portion, wherein said expandable portion will expand when heated, forming an internal expanded space which increases the internal pressure and produces a negative pressure inside the container.

Preferably, the expandable portion is made of thermal expandable material.

Preferably, the expandable portion is provided in the middle part of the container lid.

Preferably, the expandable portion is corrugated and provided on the outside of the container lid, which will expand in longitudinal direction when heated.

Preferably, the expandable portion has a folded structure which bulges into the expanded space when heated, increasing internal space. In other words, the expandable portion is folded when the liquid temperature within the container body is at room temperature, and is expanded when the liquid temperature within the container body is higher than room temperature.

Preferably, the expandable portion has corrugated shape which will extend along the transverse direction to form the expanded space when heated.

Preferably, the expandable portion has a flat structure which will expand into the expanded space compared with other parts of the container lid when heated.

In accordance with another aspect of the invention, the present invention comprises a container lid which is adapted to a container body to form a container for containing liquid, further comprising:

An expandable portion, wherein the expandable portion is connected to the container lid as an integral, which will expand into the expanded space when heated. Steam will travel into the expanded space and produce a negative pressure to prevent the leakage of the container.

In accordance with another aspect of the invention, the present invention also provide a container comprising a container lid and a container body, wherein the container lid is adapted to the container body to form the container. The container lid comprising a drinking hole, further comprising:

A protective cover which covers the surface of the container lid to protect the drinking hole and surrounding area, wherein the protective cover comprises a sealing portion which is adapted to the drinking hole to seal the drinking hole.

The protective cover further comprises a fixing portion which is provided on the edge of the protective cover to connect the protective cover and the container lid.

The protective cover further comprises an operating portion which is formed by extending outwardly from an edge of the protective cover and used to separate the sealing portion and the drinking hole.

The container lid comprises a restraint slot which is adapted to the sealing portion to accept the sealing portion and locate the protective cover.

Preferably, the protective cover is adapted to the shape of the container lid.

The container further comprises an expandable portion which will form an expanded space when heated, increasing the internal space of the container and forming a negative pressure to improve the containment.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
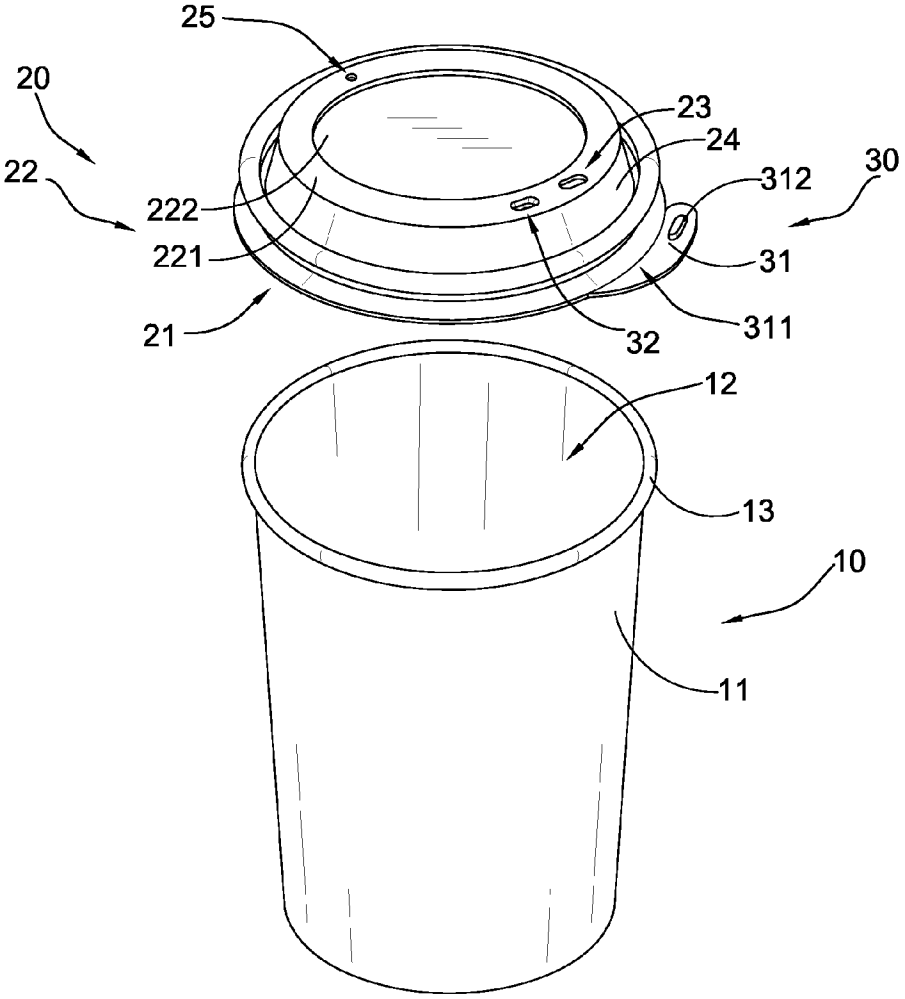
FIG. 1 is a perspective view of a lid of a disposable beverage cup according to a first preferred embodiment of the present invention.

Referring to FIG. 1 of the drawings, a lid for a container according to a first preferred embodiment is illustrated, wherein the container 10 is embodied as a disposable beverage cup for containing beverage, as an example. The container 10 has a container wall 11, a top opening 12, and an opening edge 13. In particular, the opening edge 13 of the container 10 preferably has a thickened configuration to retain the shape of the top opening 12.

According to a first preferred embodiment, the lid, which can be a disposable lid, comprises a lid cover 20 and an enclosure arrangement 30. The lid can be made of disposable material, such as plastic, and can be made by any existing manufacturing process.

Figure 2:
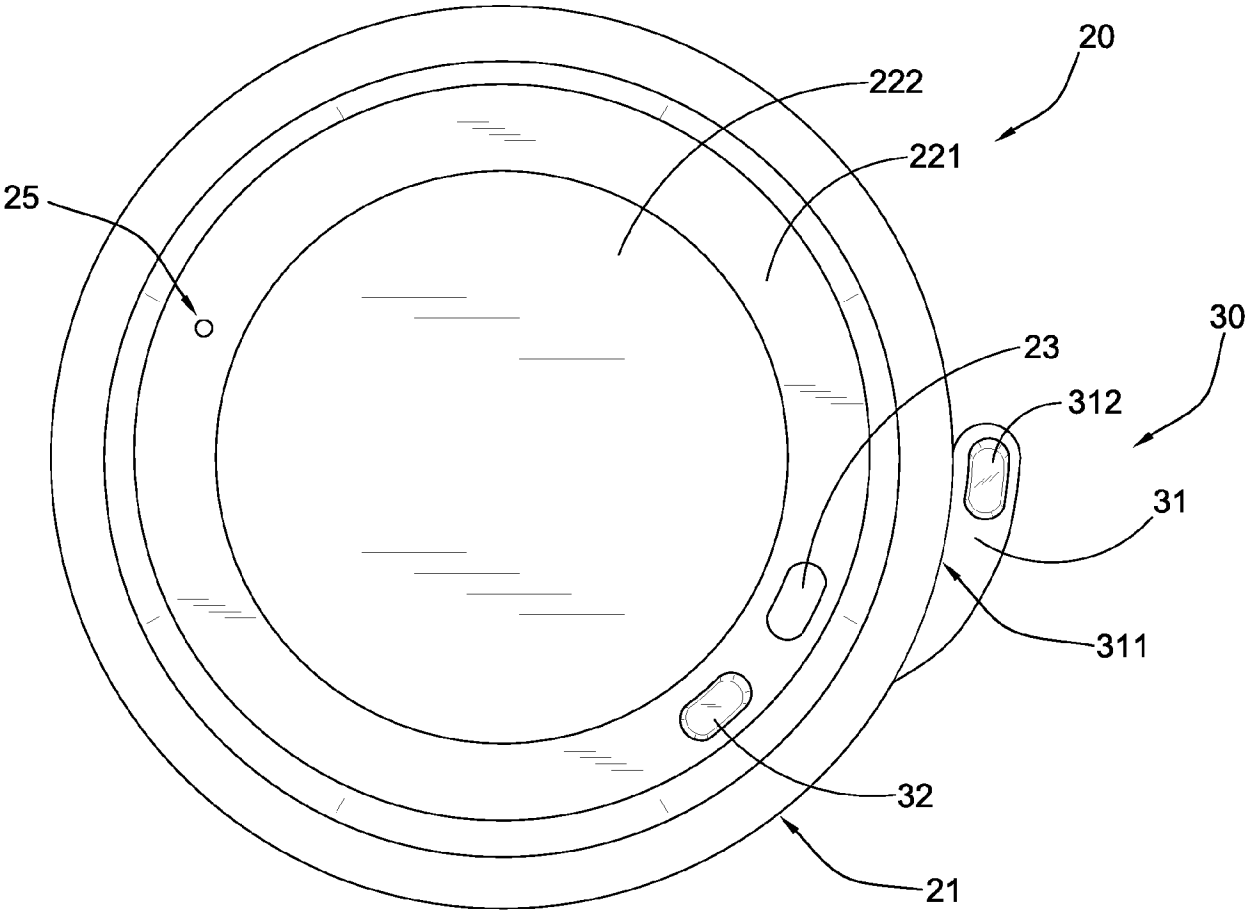
FIG. 2 is a top view of the lid according to the above first preferred embodiment of the present invention.
Figure 3:
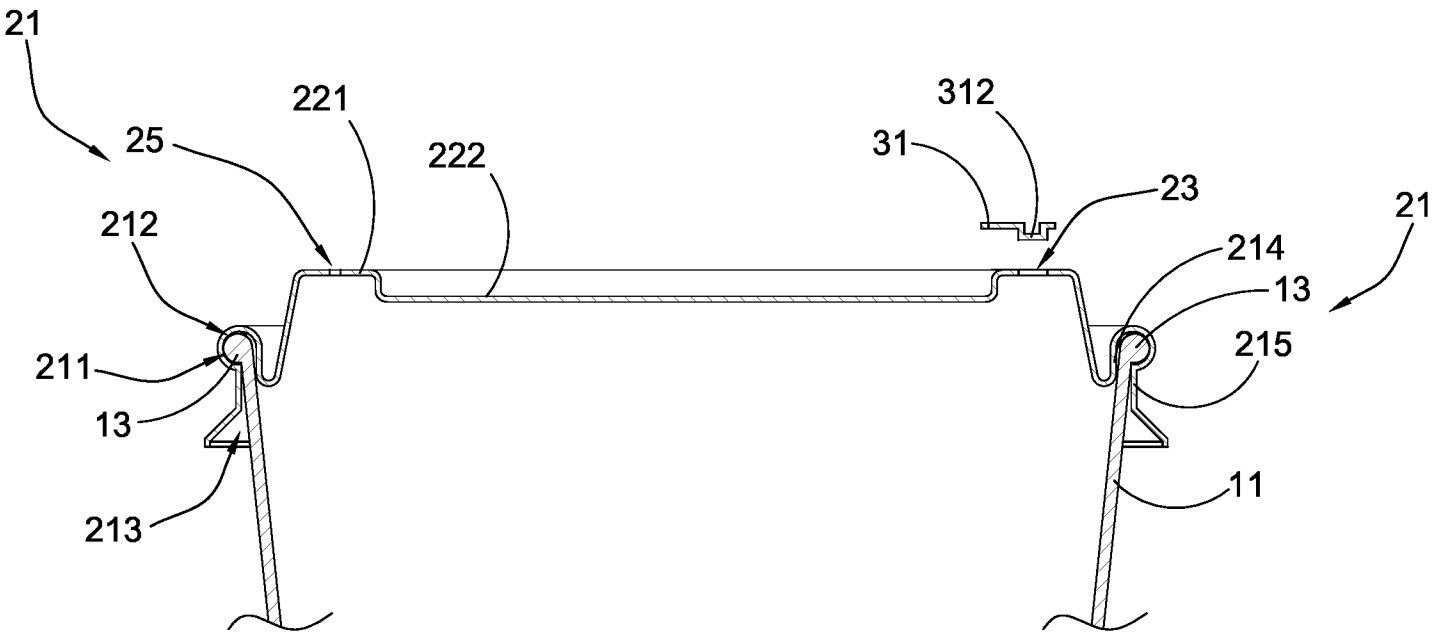
FIG. 3 is a sectional view of the lid according to the above first preferred embodiment of the present invention.

As shown in FIGS. 1 to 3, the lid cover 20, which is preferably form in a circular shape, has a peripheral sealing edge 21 for sealing at the opening edge 13 of the container 10 and a top cover 22 for covering at the top opening 12 of the container 10, wherein when the container 10 is covered by the lid cover 20, a container cavity of the container 10 is concealed. Accordingly, the lid cover 20 further has a drinking hole 23, which is a through hole, provided on the top cover 22 for communicating with the container cavity of the container 10. In other words, the user is able to drink the beverage in the container 10 through the drinking hole 23. It is worth mentioning that the size and shape of the drinking hole 23 can be altered such as circular hole, oval hole, or bean shaped hole.

According to the preferred embodiment, the lid cover 20 comprises a surrounding wall 24 downwardly extended from the top cover 22 to define the sealing edge 21 at a bottom edge of the surrounding wall 24. The top cover 22 further has a peripheral raised deck 221 and a center lowered platform 222, wherein the drinking hole 23 is formed at the peripheral raised deck 221 of the top cover 22.

The lid cover 20 further has an air vent 25 provided on the top cover 22 for enabling air passing therethrough. Preferably, the air vent 25 is provided at the peripheral raised deck 221 of the top cover 22 at a position along the diameter of the top cover 22 to maximize the distance between the drinking hole 23 and the air vent 25. Accordingly, the size of the air vent 25 is smaller than the size of the drinking hole 23, wherein the air vent 25 is used for maintaining and balancing the interior pressure of the container 10 with the exterior thereof during drinking when the lid cover 20 is sealed at the container 10. In other words, when the user drinks the beverage through the drinking hole 23, the ambient air will enter into the cavity of the container 10 through the air vent 25 to ensure the beverage to be smoothly flow out of the container 10 through the drinking hole 23. Preferably, the air vent 25 is small enough for only enabling air passing therethrough.

According to the preferred embodiment, the sealing edge 21 of the lid cover 20, having an invert U-shape, defines sealing cavity 211 having an enlarged top closed end 212 and an elongated bottom open end 213 for sealing with and receiving the opening edge 13 of the container 10 at the sealing cavity 211. In particular, the sealing edge 21 of the lid cover 20 comprises an inner wall 214 and an outer wall 215 to define the sealing cavity 211 therebetween. The inner wall 214 is upwardly and integrally extended from the surrounding wall 24 of the lid cover 20. The inner and outer walls 214, 215 are integrally extended at the top sides thereof to define the enlarged top closed end 212 while the bottom sides of the inner and outer walls 214, 215 form the elongated bottom open end 213. Therefore, when the lid cover 20 covers on the top opening 12 of the container 10, the opening edge 13 of the container 10 is sealed at and received in the enlarged top closed end 212 while an upper portion of the container wall 11 is received between the inner and outer walls 214, 215 in a sealedly sandwiched manner.

The enclosure arrangement 30 comprises a drinking hole plug 31 integrally extended from the lid cover 20. In particular, the drinking hole plug 31 is integrally and outwardly extended from the sealing edge 21 of the lid cover 20 in a detachably tearable manner. Therefore, the drinking hole plug 31 can be detached from the lid cover 20. After the drinking hole plug 31 is torn off from the lid cover 20, the drinking hole plug 31 is detachably engaged with and sealed at the drinking hole 23 for preventing beverage in the container 10 being leaked from the drinking hole 23.

As shown in FIGS. 2 and 3, the drinking hole plug 31 comprises a plug platform defining a tearable edge 311 integrally extended from the sealing edge 21 of the lid cover 20 and a plugging portion 312 upwardly protruded from the plug platform. The drinking hole plug 31 can be completely torn off from the sealing edge 21 of the lid cover 20 at the tearable edge 311, such that the plugging portion 312 of the drinking hole plug 31 can be detachably engaged with and sealed at the drinking hole 23. Accordingly, the size and shape of the plugging portion 312 of the drinking hole plug 31 matches with the size and shape of the drinking hole 23. It is worth mentioning that once the plugging portion 312 of the drinking hole plug 31 is fitted to the drinking hole 23, the drinking hole 23 will be completely sealed for prevent any leakage therethrough.

Accordingly, during the manufacturing process of the lid cover 20, the drinking hole plug 31 is formed at the same time to integrally form with the lid cover 20. Then, a tearing line may be formed at the tearable edge 311 of the drinking hole plug 31 to enable the user to easily tear off the drinking hole plug 31 from the lid cover 20. It is worth mentioning that two or more lids of the present invention can be stacked with each other to minimize the storage space of the lids.

The enclosure arrangement 30 further comprises a drinking plug pit 32 indently provided on the top cover 22 at a position adjacent to the drinking hole 23, such that after the drinking hole plug 31 is torn off from the lid cover 20, the drinking hole plug 31 is detachably engaged with the drinking plug pit 32 so as to temporally hold the drinking hole plug 31. In other words, the drinking hole plug 31 is selectively and detachably engaged with one of the drinking hole 23 and the drinking plug pit 32. When the drinking hole plug 31 is engaged with the drinking hole 23, the drinking hole 23 is sealed by the drinking plug 31. When the drinking hole plug 31 is engaged with the drinking plug pit 32, the drinking hole plug 31 is temporally held. As shown in FIG. 2, the drinking plug pit 32 is an indention formed at the top cover 22 of the lid cover 20, wherein the drinking plug pit 32 is not a through hole.

In particular, the plugging portion 312 of the drinking hole plug 31 is detachably engaged with the drinking plug pit 32 at a position that the plugging portion 312 of the drinking hole plug 31 is biased against a bottom side of the drinking plug pit 32. Therefore, when the user wants to seal the container 10, the user is able to plug the drinking hole plug 31 at the drinking hole 23 to completely seal the lid cover 20. When the user wants to drink the beverage, the user is able to detach the drinking hole plug 31 from the drinking hole 23 and then plug the drinking hole plug 31 at the drinking plug pit 32 to hold the drinking hole plug 31, so as to prevent the drinking hole plug 31 being lost.

In order to use the lid of the present invention, the user is able to fill the beverage into the container 10 and cover the lid cover 20 at the top opening 12 of the container 10, such that the user is able to drink the beverage through the drinking hole 23. For carrying or storing the container 10, the user is able to tear the drinking hole plug 31 from the lid cover 20 and plug the drinking hole plug 31 at the drinking hole 23. Therefore, the drinking hole 23 will be completely sealed by the drinking hole plug 31.

Figure 4:
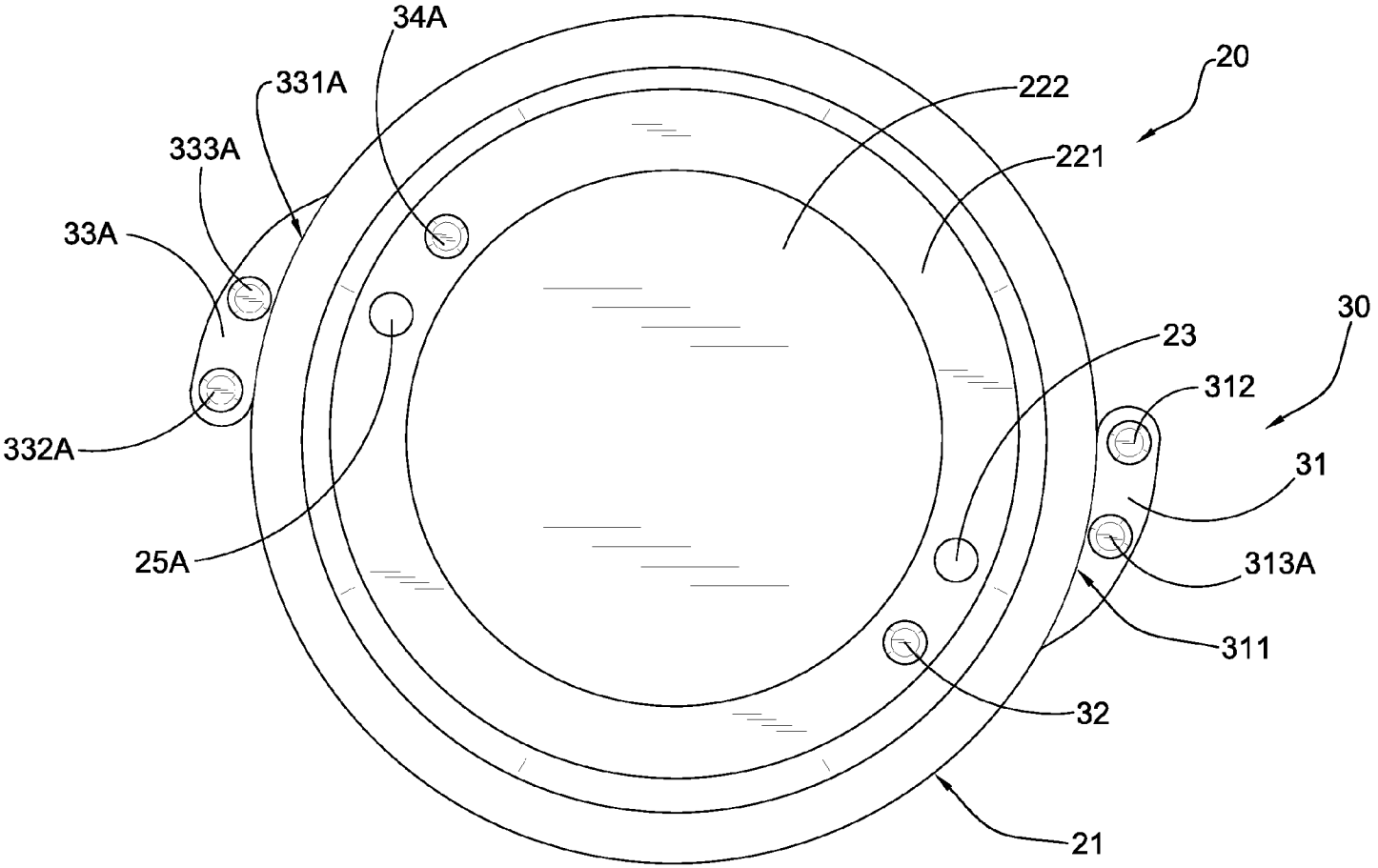
FIG. 4 is a top view of a lid according to a second preferred embodiment of the present invention.
Figure 5:
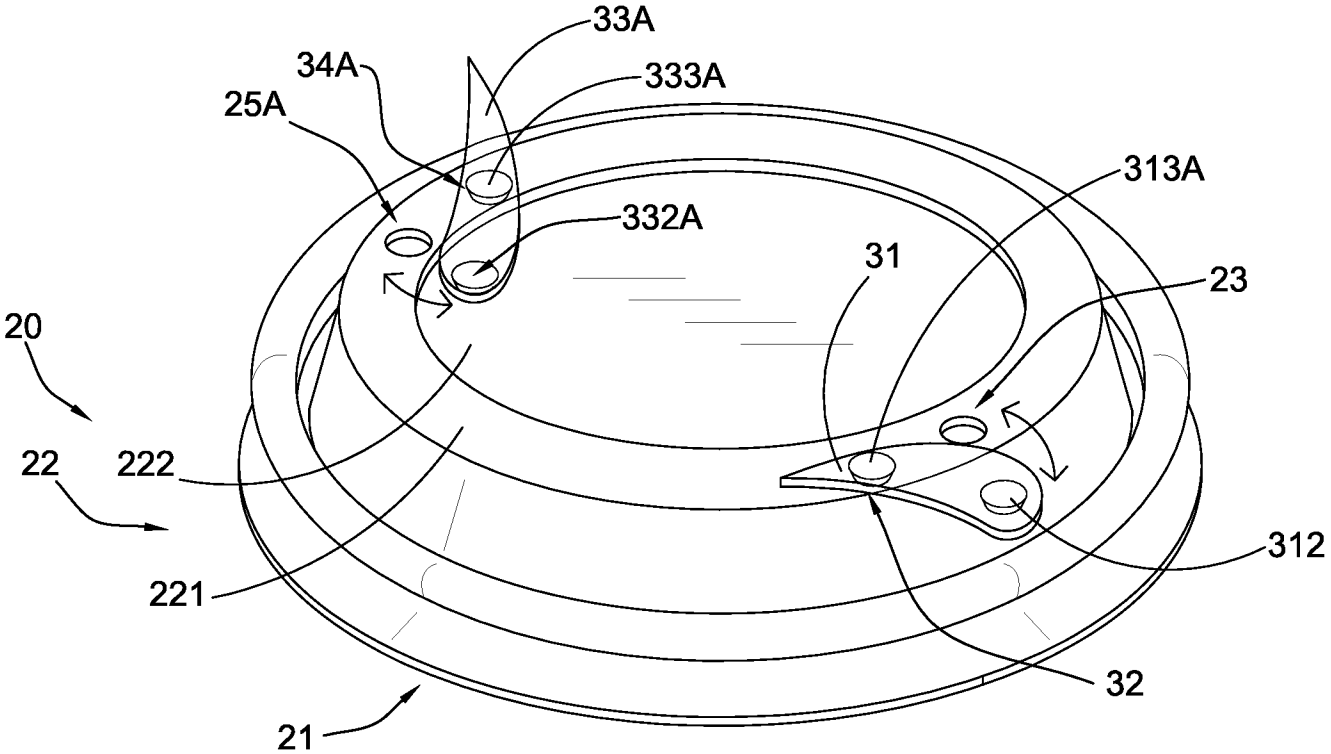
FIG. 5 is a top view of the lid according to the above second preferred embodiment of the present invention, illustrating the rotational movement of the enclosure arrangement.

As shown in FIGS. 4 and 5, a lid according to a second embodiment illustrates a modification of the first embodiment, wherein the size of the air vent 25A is slightly enlarged for enabling air easily to enter into the cavity of the container 10. In addition, the enclosure arrangement 30 further comprises a vent plug 33A integrally extended from the lid cover 20. In particular, the vent plug 33A is integrally and outwardly extended from the sealing edge 21 of the lid cover 20 in a detachably tearable manner. In other words, the drinking hole plug 31 and the vent plug 33A form two extension wings integrally and outwardly extended from two opposite sides of the sealing edge 21 of the lid cover 20. Therefore, the vent plug 33A can be detached from the lid cover 20. After the vent plug 33A is torn off from the lid cover 20, the vent plug 33A is detachably engaged with and sealed at the air vent 25A for preventing any external substance, such as dirt or dust, to enter into the container 10 through the air vent 25A.

According to the second embodiment, the structure of the vent plug 33A is similar to the structure of the drinking hole plug 31. The vent plug 33A comprises a vent plug platform defining a second tearable edge 331A integrally extended from the sealing edge 21 of the lid cover 20 and a vent plugging portion 332A upwardly protruded from the vent plug platform. The vent plug 33A can be completely torn off from the sealing edge 21 of the lid cover at the second tearable edge 331A, such that the vent plugging portion 332A of the vent plug 33A can be detachably engaged with and sealed at the air vent 25A. Accordingly, the size and shape of the vent plugging portion 332A of the vent plug 33A matches with the size and shape of the air vent 25A. It is worth mentioning that once the vent plugging portion 332A of the vent plug 33A is fitted to the air vent 25A, the air vent 25A will be completely sealed for prevent any leakage therethrough.

As shown in FIG. 4, the vent plug 33A and the drinking hole plug 31 are formed at the opposite side of the sealing edge 21 of the lid cover 20. Therefore, the user is able to selectively tear off the vent plug 33A and the drinking hole plug 31 from the sealing edge 21 of the lid cover 20. It is appreciated that the size and shape of the drinking hole 23 matches with the size and shape of the air vent 25A, such that the vent plug 33A and the drinking hole plug 31 are interchangeable to selectively couple with the drinking hole 23 and the air vent 25A.

According to the second embodiment, the enclosure arrangement 30 further comprises a vent plug pit 34A indently provided on the top cover at a position adjacent to the air vent 25A, such that after the vent plug 33A is torn off from the lid cover 20, the vent plug 33A is detachably engaged with the vent plug pit 34A so as to temporally hold the vent plug 33A. In other words, the vent plug 33A is selectively and detachably engaged with one of the air vent 25A and the vent plug pit 34A. When the vent plug 33A is engaged with the air vent 25A, the air vent 25A is sealed by the vent plug 33A. When the vent plug 33A is engaged with the vent plug pit 34A, the vent plug 33A is temporally held. The structure of the vent plug pit 34A is similar to the structure of the drinking plug pit 32, wherein the vent plug pit 34A is an indention formed at the top cover 22 of the lid cover 20 and is not a through hole.

In particular, the vent plugging portion 332A of the vent plug 33A is detachably engaged with the vent plug pit 34A at a position that the vent plugging portion 332A of the vent plug 33A is biased against a bottom side of the vent plug pit 34A. Therefore, when the user wants to seal the air vent 25A, the user is able to plug the vent plug 33A at the air vent 25A to completely seal the lid cover 20. When the user wants to drink the beverage, the user is able to detach the vent plug 33A from the air vent 25A and then plug the vent plug 33A at the vent plug pit 34A to hold the vent plug 33A, so as to prevent the vent plug 33A being lost. The opening of the air vent 25A allows air entering into the container 10 for enabling the user to drink easily.

Instead of detachably coupling the drinking hole plug 31 and the vent plug 33A at the drinking hole 23 and the air vent 25A, the drinking hole plug 31 and the vent plug 33A can be rotatably coupled on the top cover 22, such that the plugging portion 312 and the vent plugging portion 332A of the drinking hole plug 31 and the vent plug 33A are rotatably moved to plug in the drinking hole 23 and the air vent 25A respectively.

As shown in FIG. 4, the drinking hole plug 31 further has a holding portion 313A upwardly extended from the plug platform and spaced apart from the plugging portion 312. The distance between the plugging portion 312 and the holding portion 313A of the drinking hole plug 31 matches with the distance between the drinking hole 23 and the drinking plug pit 32. After the drinking hole plug 31 is torn off from the lid cover 20, the holding portion 313A of the drinking hole plug 31 is coupled at the drinking plug pit 32 so as to enable the drinking hole plug 31 to be rotated on the top cover 22 to detachably engage and seal the plugging portion 312 at the drinking hole 23 as shown in FIG. 5. In other words, the user is able to selectively couple the plugging portion 312 of the drinking hole plug 31 with one of the drinking hole 23 and the drinking plug pit 32. As it is mentioned above, the drinking plug pit 32 can temporally hold the drinking hole plug 31 on the top cover 22. When the user selects to couple the holding portion 313A of the drinking hole plug 31 at the drinking plug pit 32, the drinking hole plug 31 can be rotatably moved on the top cover 22. It is worth mentioning that the user is able to plug or unplug the plugging portion 312 of the drinking hole plug 31 in or from the drinking hole 23 by one hand operation. Thus, the user is able to rotatably move the drinking hole plug 31 to align with or away from the drinking hole 23 by one hand operation. Therefore, the drinking plug pit 32 provides multiple functions to retain the drinking hole plug 31 on the top cover 22.

Similarly, the vent plug 33A further has a vent holding portion 333A upwardly extended from the vent plug platform and spaced apart from the vent plugging portion 332A. The distance between the vent plugging portion 332A and the vent holding portion 333A of the vent plug 33A matches with the distance between the air vent 25A and the vent plug pit 34A. After the vent plug 33A is torn off from the lid cover 20, the vent holding portion 333A of the vent plug 33A is coupled at the vent plug pit 34A so as to enable vent plug 33A to be rotated on the top cover 22 to detachably engage and seal the vent plugging portion 332A at the air vent 25A as shown in FIG. 5. Likewise, the user is able to selectively couple the vent plugging portion 332A of the vent plug 33A with one of the air vent 25 and the vent plug pit 34A. As it is mentioned above, the vent plug pit 34A can temporally hold the vent plug 33A on the top cover 22. When the user selects to couple the vent holding portion 333A of the vent plug 33A at the vent plug pit 34A, the vent plug 33A can be rotatably moved on the top cover 22. It is worth mentioning that the user is also able to plug or unplug the vent plugging portion 332A of the vent plug 33A in or from the air vent 25A by one hand operation. Thus, the user is able to rotatably move the vent plug 33A to align with or away from the air vent 25A by one hand operation. Therefore, the vent plug pit 34A also provides multiple functions to retain the vent plug 33A on the top cover 22.

It is worth mentioning that the holding portion 313A of the drinking hole plug 31 and the vent holding portion 333A of the vent plug 33A form the rotatable axles to enable the drinking hole plug 31 and the vent plug 33A to rotate on the top cover 22.

Figure 6:
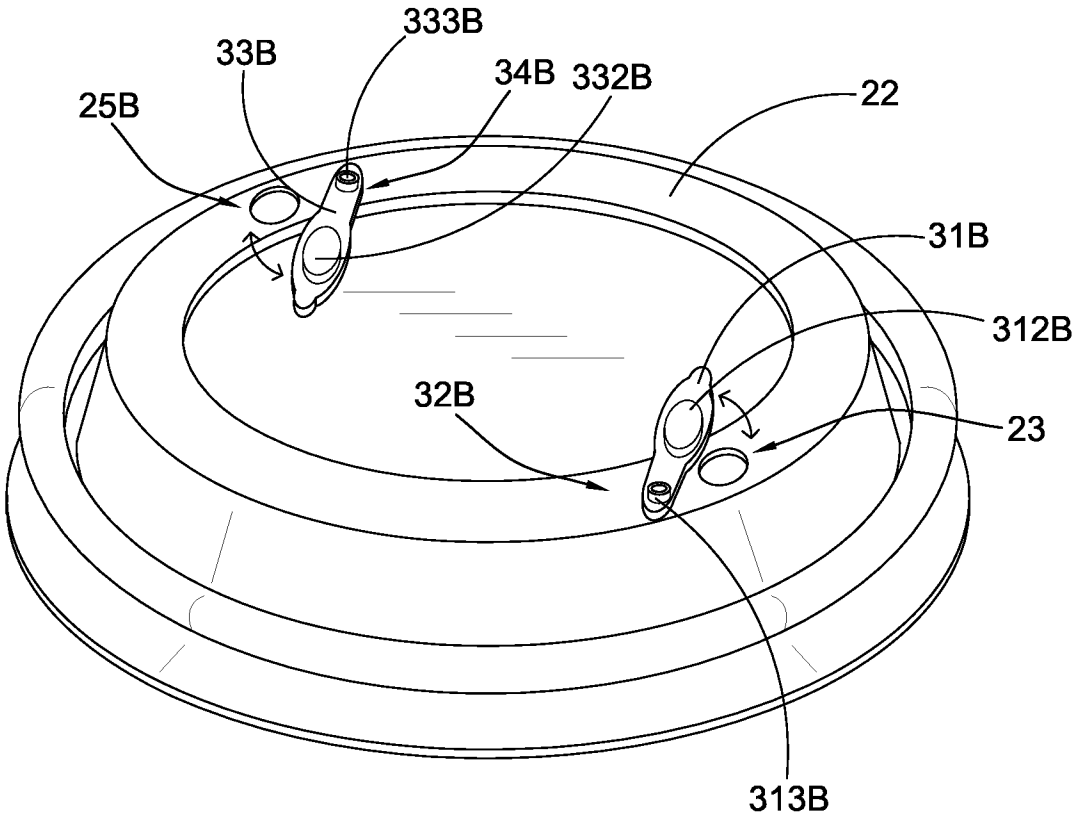
FIG. 6 illustrates a first alternative mode of the enclosure arrangement of the lid according to the above second preferred embodiment of the present invention.

FIG. 6 illustrates a first alternative mode of the second embodiment, the drinking hole plug 31B and the vent plug 33B are directly coupled on the top cover 22 at a rotatably movable manner. In other words, the drinking hole plug 31B and the vent plug 33B are not integrally extended from the sealing edge 21 of the lid cover 20 such that the user does not need to tear the drinking hole plug 31B and the vent plug 33B from the lid cover 20. In particular, the holding portion 313B of the drinking hole plug 31B is pre-coupled at the drinking plug pit 32B as a stud pin/hinge to enable the drinking hole plug 31B to be rotated on the top cover 22 so as to detachably engage and seal the plugging portion 312B at the drinking hole 23 as shown in FIG. 6. Likewise, the vent holding portion 333B of the vent plug 33B is pre-coupled at the vent plug pit 34B as another stud pin/hinge to enable vent plug 33B to be rotated on the top cover 22 so as to detachably engage and seal the vent plugging portion 332B at the air vent 25B as shown in FIG. 6.

Figure 7:
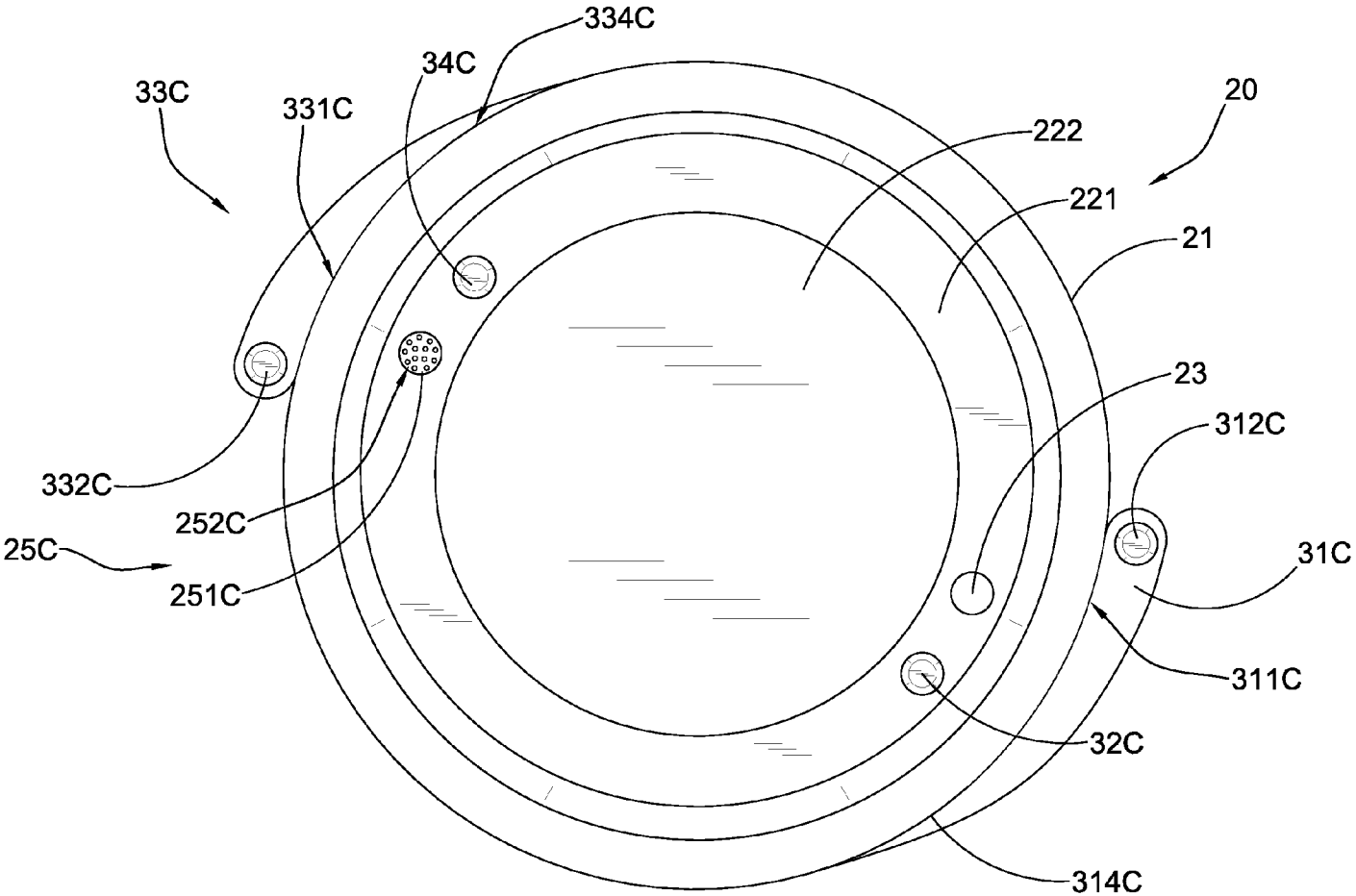
FIG. 7 illustrates a second alternative mode of the enclosure arrangement of the lid according to the above second preferred embodiment of the present invention.
Figure 8:
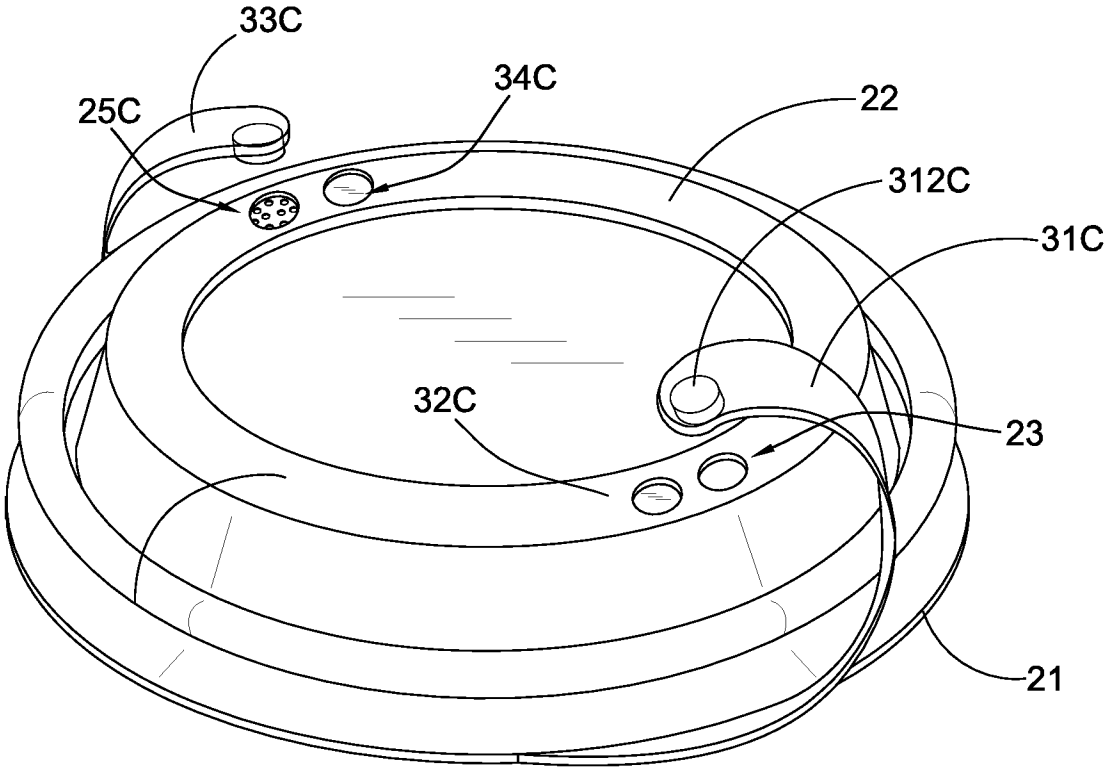
FIG. 8 illustrates the second alternative mode of the enclosure arrangement of the lid according to the above second preferred embodiment of the present invention, showing the drinking hole plug partially torn to plug in the drinking hole.

FIGS. 7 and 8 illustrates an alternative mode of the air vent 25C, wherein the air vent 25C is an indention formed at the top cover 22 of the lid cover 20 to define a bottom wall 251C. The air vent 25C further has a plurality of air pores 252C formed at the bottom wall 251C for enabling air passing therethrough. It is worth mentioning that the user is able to poke through the bottom wall 251C of the air vent 25C via the air pores 252C, for example by a straw, to form a poke hole such that the air pores 252C also form the perforation holes of the bottom wall 251C of the air vent 25C.

FIGS. 7 and 8 further illustrate a second alternative mode of the second embodiment, wherein the drinking hole plug 31C is integrally and outwardly extended from the sealing edge 21 of the lid cover 20 in a partially detachably tearable manner. Therefore, the drinking hole plug 31C can be partially detached from the lid cover 20. After the drinking hole plug 31C is partially torn off from the lid cover 20, the drinking hole plug 31C is detachably engaged with and sealed at the drinking hole 23 for preventing beverage in the container 10 being leaked from the drinking hole 23.

In particular, the plug platform can be extended at its length that a free end portion of the plug platform is integrally extended from the sealing edge 21 of the lid cover 20 to define a non-tearable edge 314C and a tearable edge 311C integrally extended from the sealing edge 21 of the lid cover 20. Therefore, the plug platform can be partially torn off from the sealing edge 21 of the lid cover 20 at the tearable edge 311C only while the plug platform is remained attached to sealing edge 21 of the lid cover at the non-tearable edge 314C. As a result, the plugging portion 312C of the drinking hole plug 31C can be detachably engaged with and sealed at the drinking hole 23. It is appreciated that the drinking hole plug 31C can be selectively engaged with one of the drinking hole 23 and the drinking plug pit 32C.

The structure of the vent plug 33C is similar to the structure of the drinking hole plug 31C, wherein the vent plug 33C is integrally and outwardly extended from the sealing edge 21 of the lid cover 20 in a partially detachably tearable manner. After the vent plug 33C is partially torn off from the lid cover 20, the vent plug 33C is detachably engaged with and sealed at the air vent 25C.

The vent plug platform can be extended at its length that a free end portion of the vent plug platform is integrally extended from the sealing edge 21 of the lid cover 20 to define a second non-tearable edge 334C and a second tearable edge 331C integrally extended from the sealing edge 21 of the lid cover 20. Therefore, the vent plug platform can be partially torn off from the sealing edge 21 of the lid cover 20 at the second tearable edge 331C only while the plug platform is remained attached to sealing edge 21 of the lid cover at the second non-tearable edge 334C. As a result, the vent plugging portion 332C of the vent plug 33C can be detachably engaged with and sealed at the air vent 25C. It is worth mentioning that the vent plug 33C can also be incorporated to detachably engage with and sealed at the air vent 25A. It is appreciated that the vent plug 33C can be selectively engaged with one of the air vent 25C and the vent plug pit 34C.

Accordingly, the plug platform of the drinking hole plug 31C and the vent plug platform of the vent plug 33C are made of flexible material, such that after the plug platform of the drinking hole plug 31C and the vent plug platform of the vent plug 33C, the plug platform of the drinking hole plug 31C and the vent plug platform of the vent plug 33C can be bent and flipped to engage with the drinking hole 23 and the air vent 25C. In other words, the plug platform of the drinking hole plug 31C and the vent plug platform of the vent plug 33C are long enough that the plugging portion 312C of the drinking hole plug 31C and the vent plugging portion 332C of the vent plug 33C can reach the drinking hole 23 and the air vent 25C.

It is worth mentioning that since the drinking hole plug 31C and the vent plug 33C are partially torn off from the sealing edge 21 of the lid cover 20, the end portions of the drinking hole plug 31C and the vent plug 33C are also held at the sealing edge 21 of the lid cover 20. Therefore, the holding portion 313A and the vent holding portion 333A can be omitted.

Figure 9:
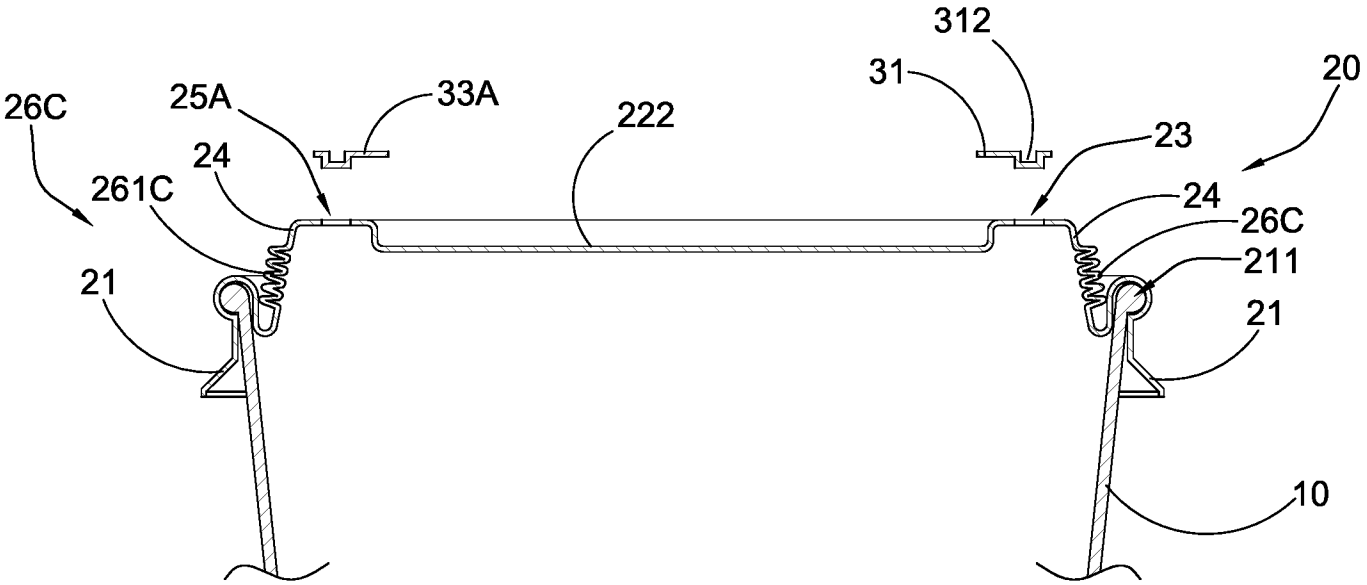
FIG. 9 is a sectional view of a lid according to a third preferred embodiment of the present invention.
Figure 10:
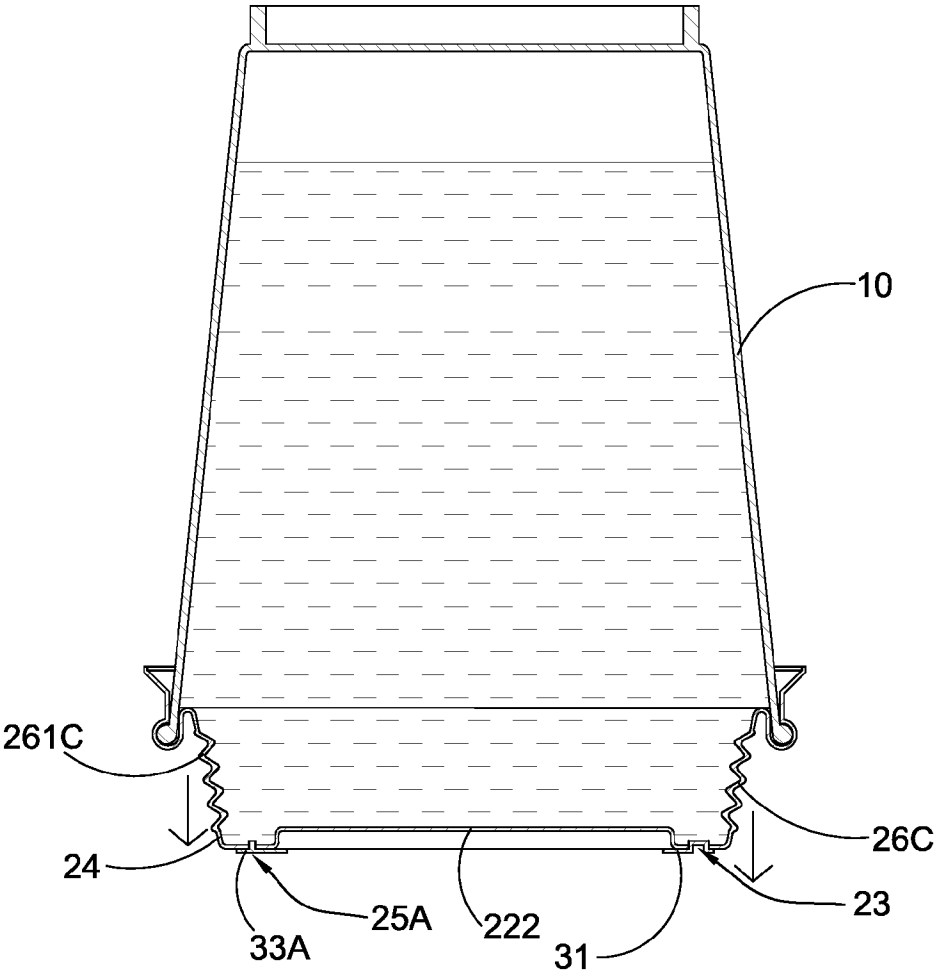
FIG. 10 is a sectional view of the lid according to the above third preferred embodiment of the present invention, illustrating the side expansion membrane.

As shown in FIGS. 9 and 10, a third embodiment of the lid illustrates a modification of the first and second embodiments of the present invention. According to the third embodiment, the lid cover 20 further comprises an expansion membrane 26C for creating a negative pressure within the container 10 when the container 10 is placed in a non upright position, i.e. the container 10 is tilted or is placed up-side-down.

As shown in FIG. 9, the expansion membrane 26C is formed at the surrounding wall 24 of the lid cover 20 as a side expansion membrane. In particular, the expansion membrane 26C comprises a corrugated wall 261C integrally formed at the surrounding wall 24. In other words, at least a portion of the surrounding wall 24 is formed in a corrugated shape.

According to the preferred embodiment, the expansion membrane 26C can be deformed to expand the volume of the container 10 with the lid cover 20. For example, when the container 10 is placed up-side-down or tilted, the beverage will be filled at the lid cover 20. The weight of the beverage will push the lid cover 20 downwardly to stretch out the corrugated wall 261C at the surrounding wall 24. In other words, the top cover 22 will be forced to move away from the top opening 12 of the container 10 or the overall height of the lid cover 20 will be substantially increased via the stretched surrounding wall 24, as shown in FIG. 10.

When the volume of the container 10 with the lid cover 20 is expanded, in condition that the container 10 is located up-side-down, the negative pressure is created in the container 10. Since the ambient pressure is larger than the interior pressure of the container 10, the larger ambient pressure will prevent the beverage from being leaked out through the drinking hole 23 or the air vent 25A. In other words, the expansion membrane 26C will cause the lid cover 20 being popped open from the container 10 due to hot coffee (or hot beverage) sudden mix with relatively cold air therein and cause a quenching effect and sudden interior air pressure surge, otherwise.

Figure 11:
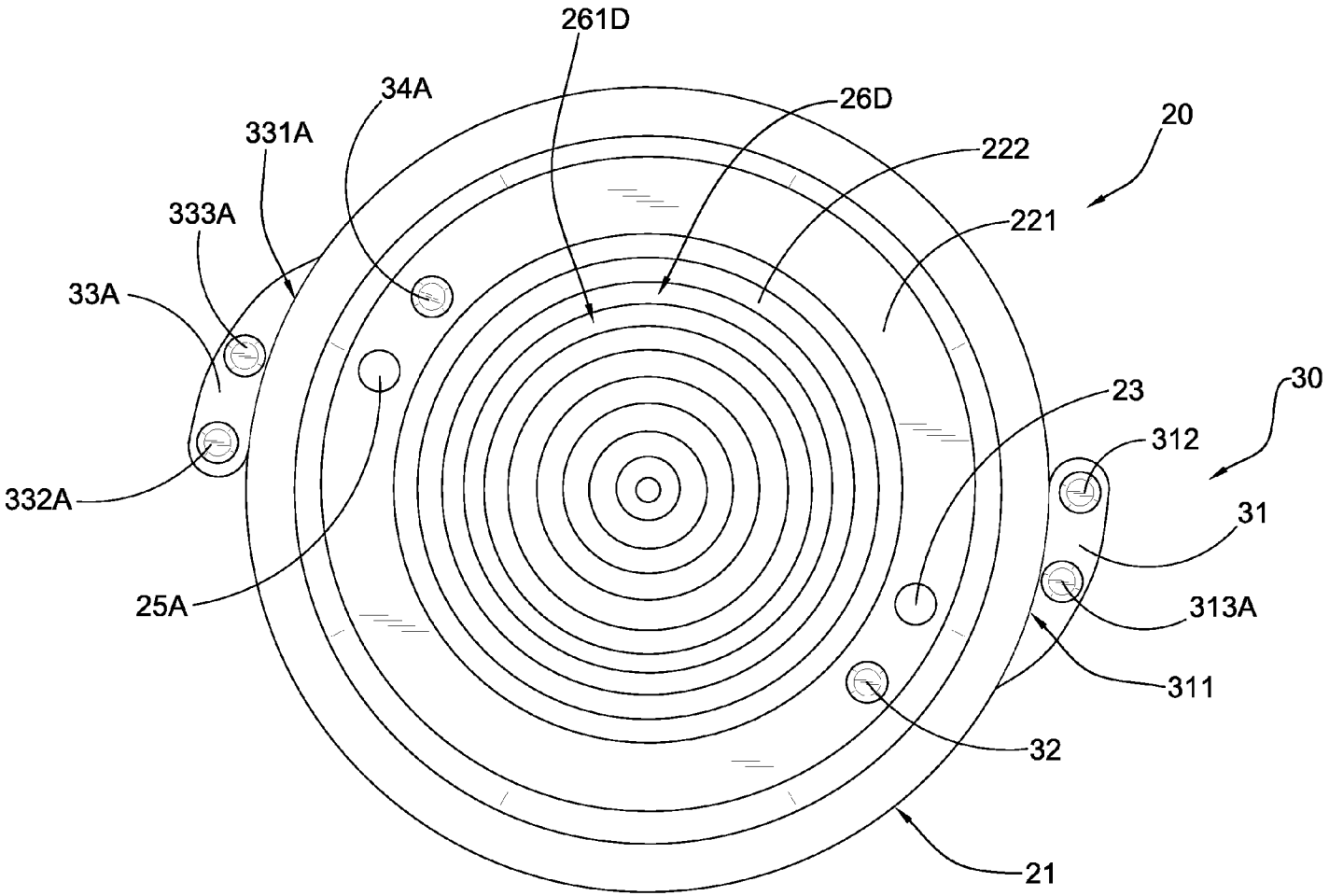
FIG. 11 is a top view of a lid according to a fourth preferred embodiment of the present invention.
Figure 12:
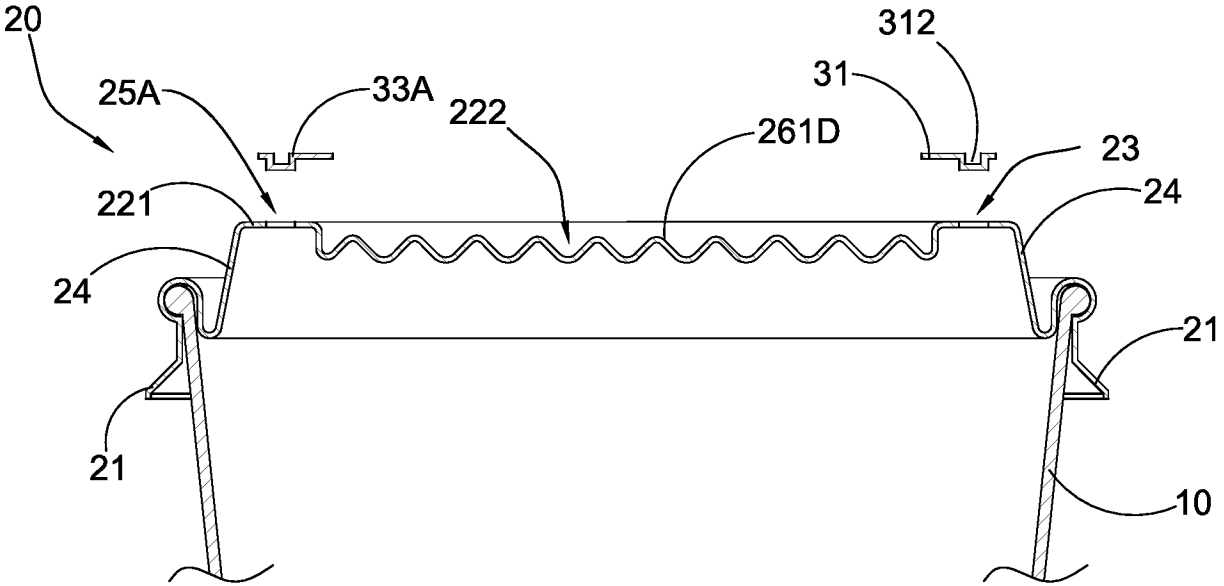
FIG. 12 is a sectional view of the lid according to the above fourth preferred embodiment of the present invention.

FIGS. 11 and 12 illustrate an alternative mode of the expansion membrane 26D of the third embodiment, wherein the expansion membrane 26D is formed at a top side of the lid cover 20. In particular, the expansion membrane 26D is formed at the center lowered platform 222 of the lid cover 20 as a top expansion membrane. In particular, the expansion membrane 26D comprises a corrugated wall 261D integrally formed at the center lowered platform 222 of the lid cover 20. In other words, at least a portion of the center lowered platform 222 of the lid cover 20 is formed in a corrugated shape.

Figure 13:
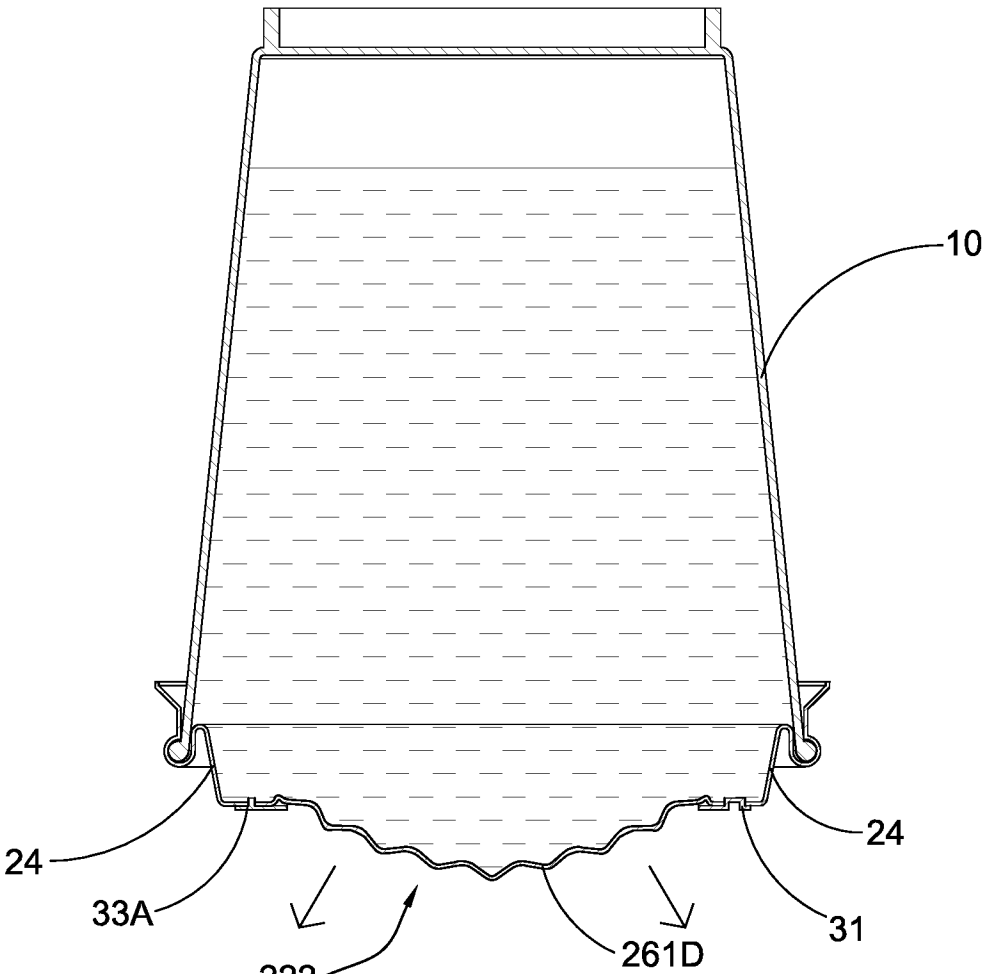
FIG. 13 is a sectional view of the lid according to the above fourth preferred embodiment of the present invention, illustrating the top expansion membrane.

Likewise, the expansion membrane 26D can be deformed to expand the air volume of the container 10 with the lid cover 20. For example, when the container 10 is placed up-side-down, the beverage will be filled at the lid cover 20. The weight of the beverage will push the lid cover 20 downwardly to stretch out the corrugated wall 261D at the center lowered platform 222 of the lid cover 20. In other words, the center lowered platform 222 of the lid cover 20 will be forced to move away from the top opening 12 of the container 10 or the overall height of the lid cover 20 will be substantially increased via the stretched center lowered platform 222 of the lid cover 20, as shown in FIG. 13. It is worth mentioning that when the center lowered platform 222 of the lid cover 20 is stretched, the center lowered platform 222 of the lid cover 20 forms a conical shape. It is appreciated that the expansion membrane 26D can be a flexible membrane formed at the center lowered platform 222 of the lid cover 20 to create the negative pressure. In addition, the flexible membrane can be transparent that the user is able to see through the flexible membrane.

Figure 14:
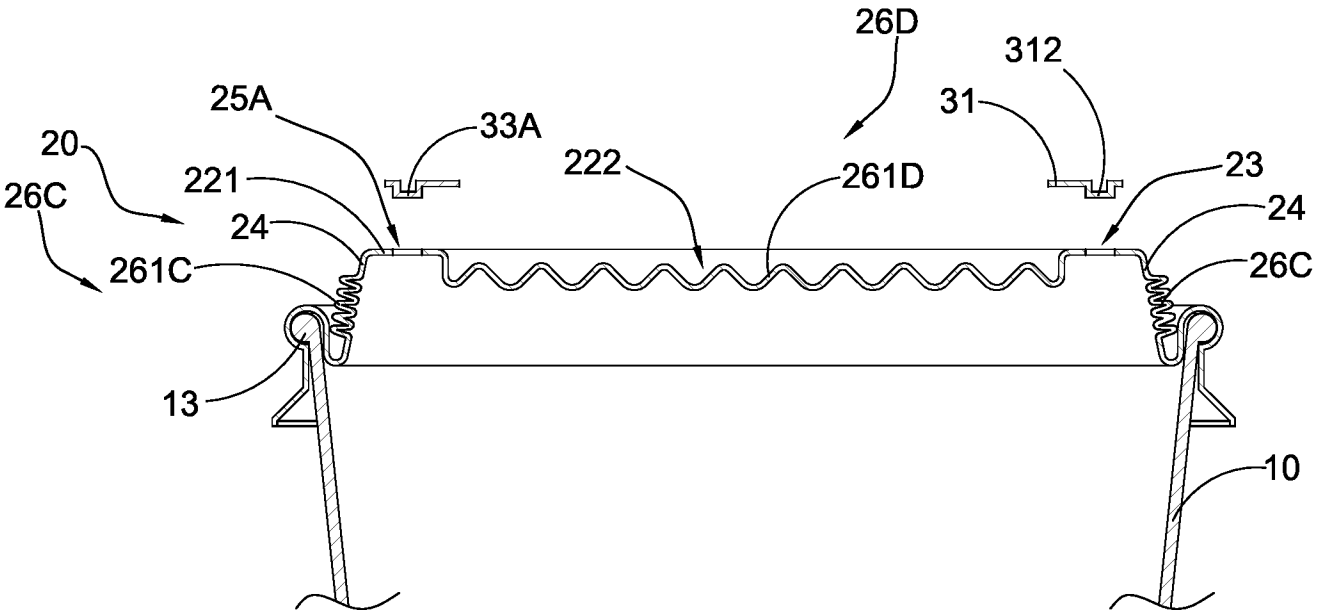
FIG. 14 is a sectional view of the lid according to a fifth preferred embodiment of the present invention, illustrating the top and side expansion membranes.

FIG. 14 illustrates a combination of the top and side expansion membranes. Accordingly, the expansion membranes 26C, 26D are formed at surrounding wall 24 and the center lowered platform 222 of the lid cover 20 respectively. Therefore, when the container 10 is placed up-side-down, the weight of the beverage will stretch out the corrugated wall 261C at the surrounding wall 24 and push down the corrugated wall 261D at the center lowered platform 222 of the lid cover 20 at the same time. Accordingly, the negative pressure will be substantially increased.

Figure 15:
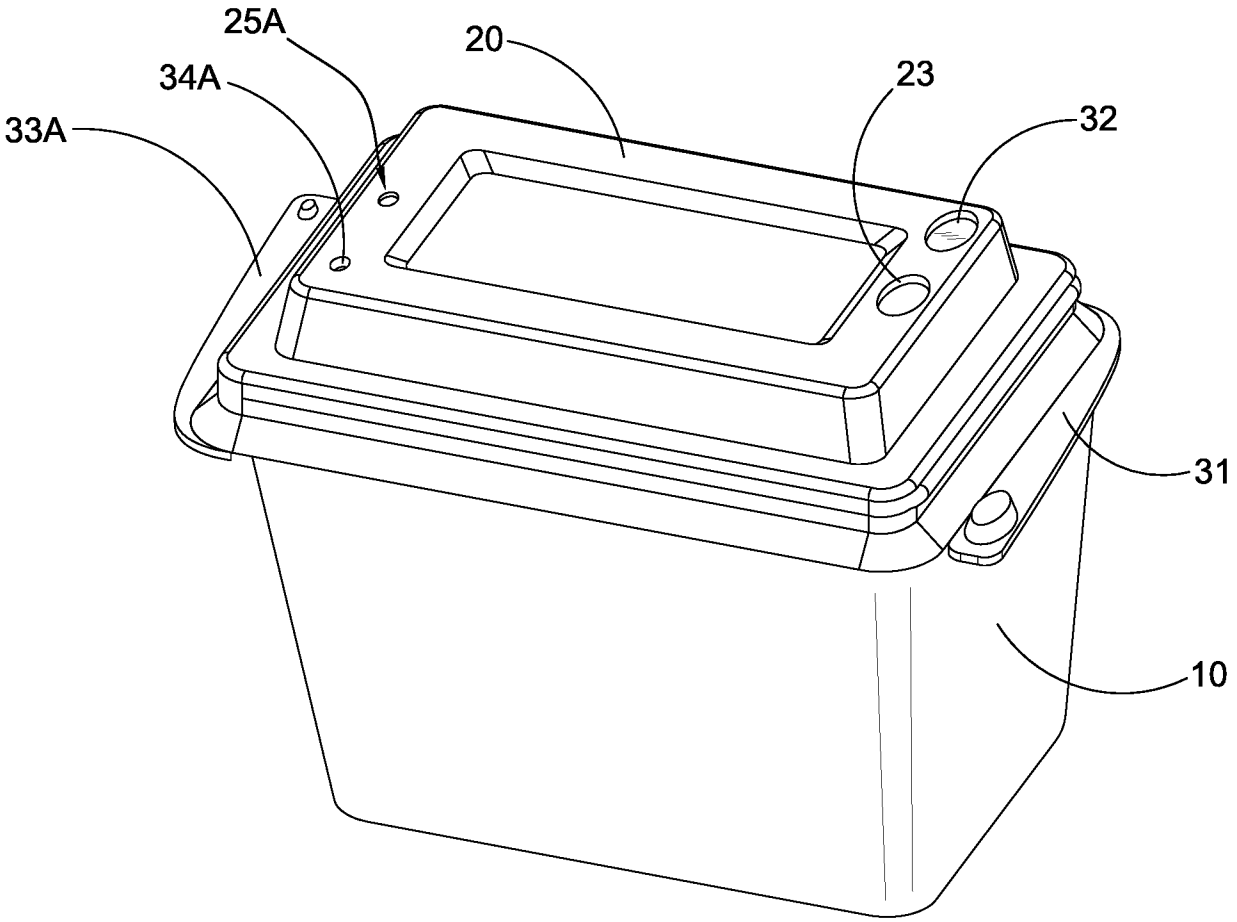
FIG. 15 illustrates an alternative mode of the lid for the disposable beverage cup according to the above first to fifth preferred embodiments of the present invention, illustrating the lid in a different shape.
Figure 16:
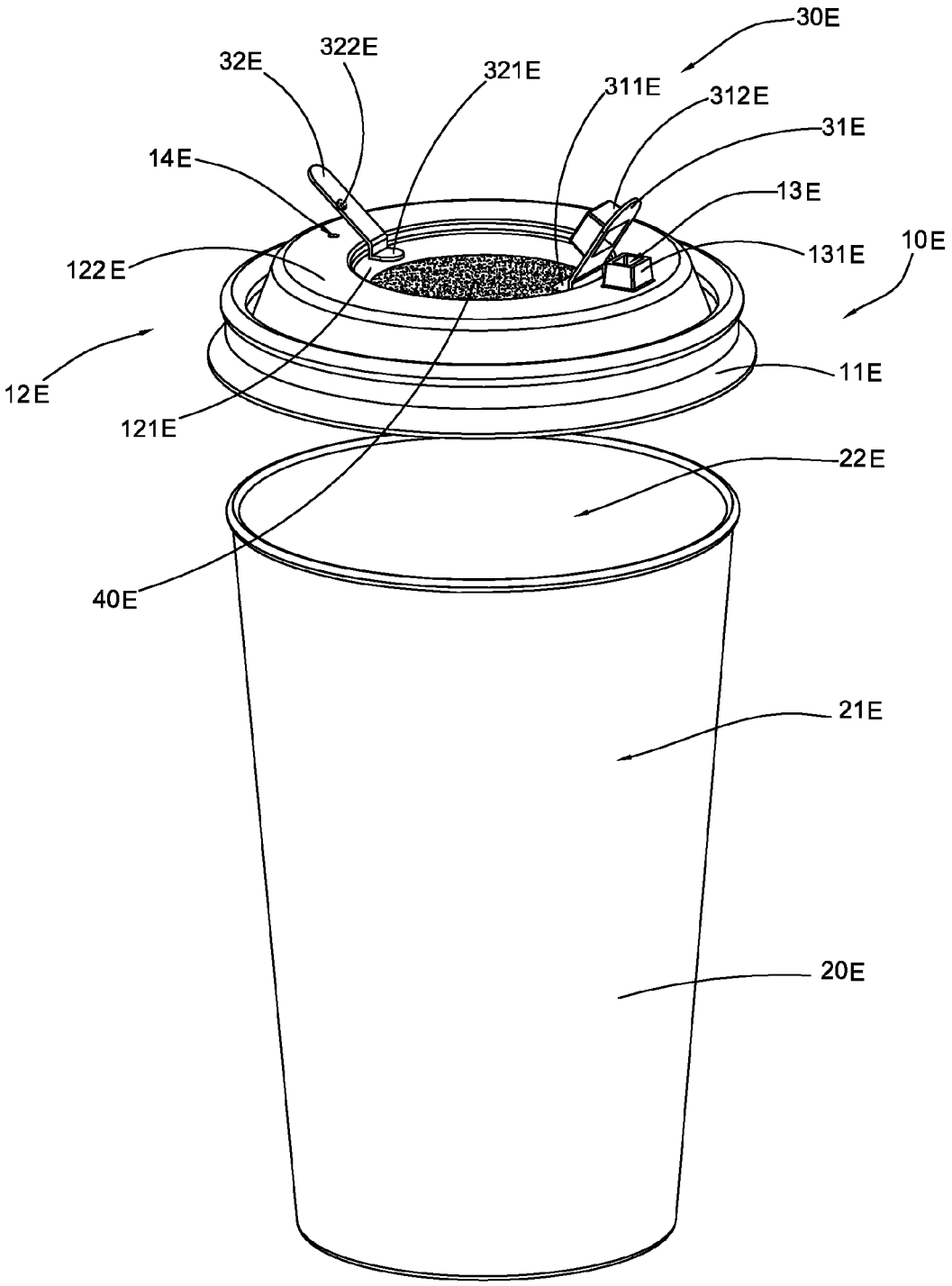
FIG. 16 is a structural diagram of a container and a container lid according to a sixth preferred embodiment of the present invention.
Figure 17:
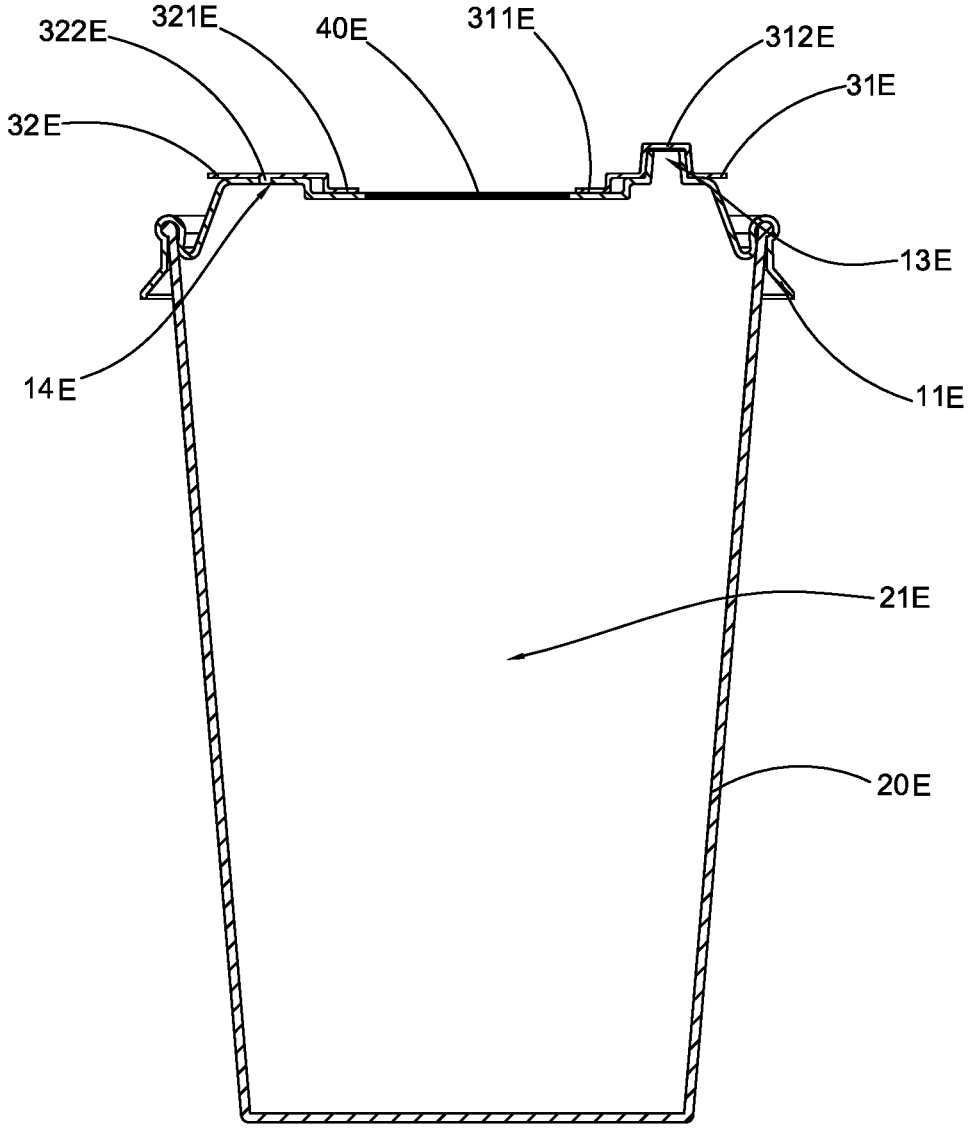
FIG. 17 is a sectional view of a container and a container lid according to above sixth preferred embodiment of the present invention.
Figure 18:
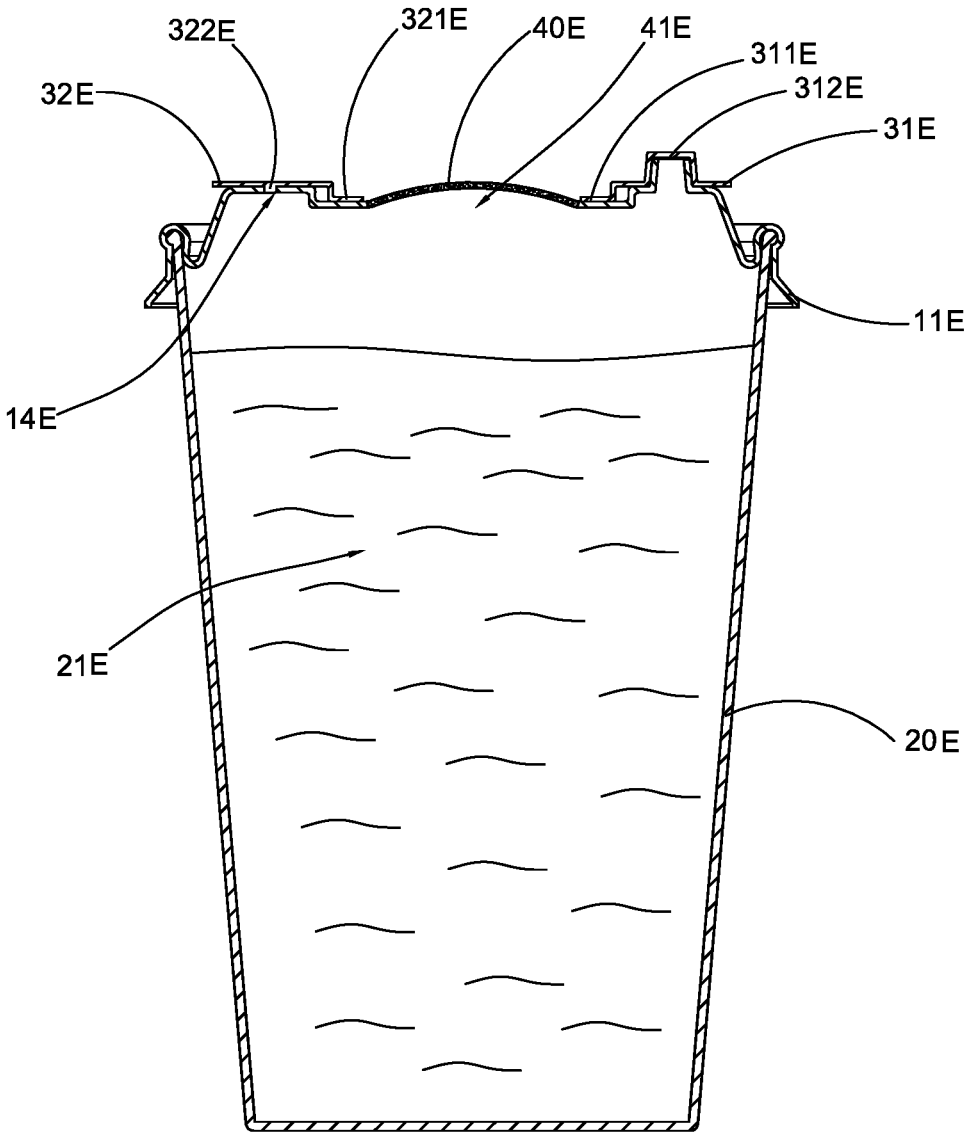
FIG. 18 is a sectional view of a container and a container lid after being filled with liquid according to above sixth preferred embodiment of the present invention.
Figure 19A:
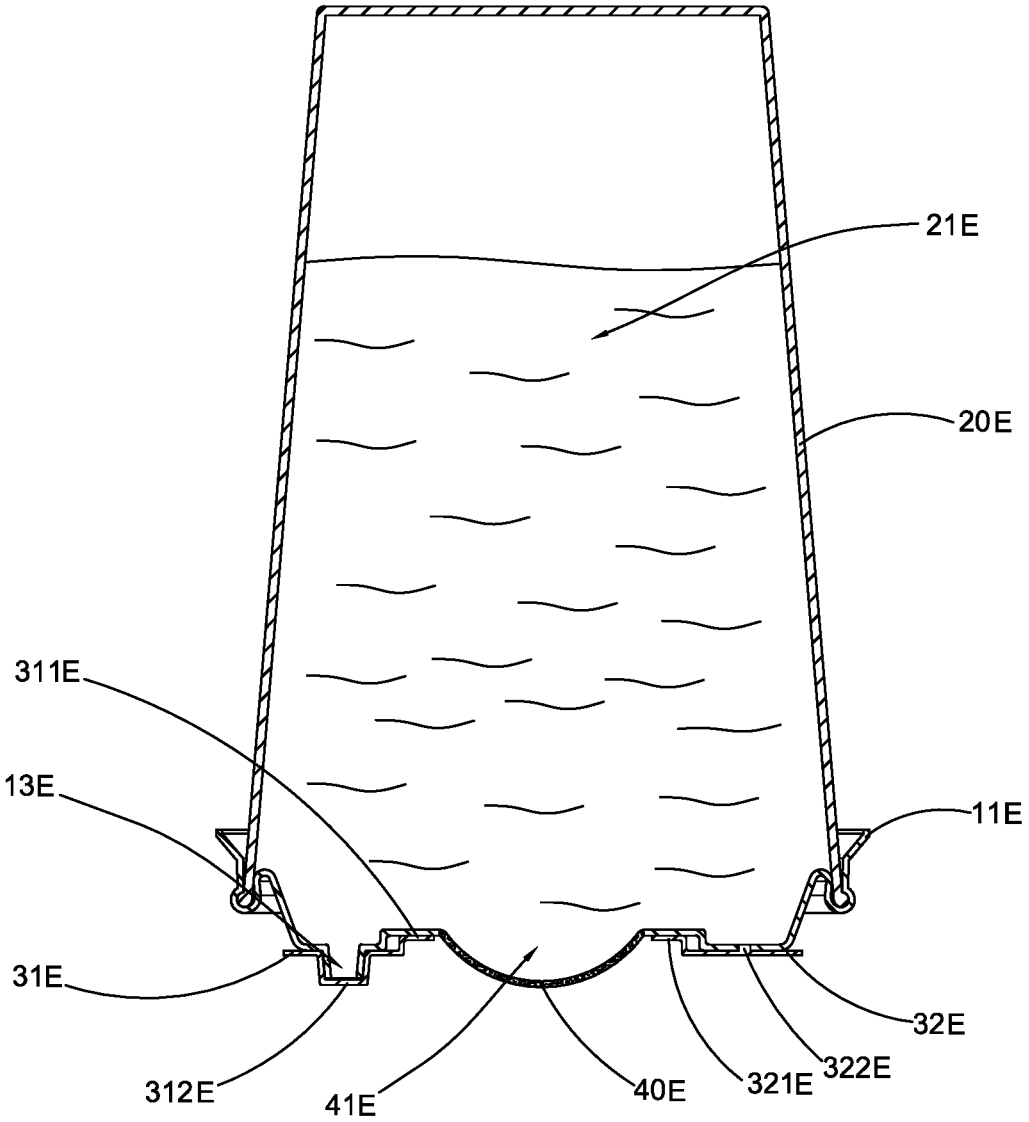
FIG. 19A is a sectional view of a container and a container lid after being filled with liquid in upside-down status according to above sixth preferred embodiment of the present invention.
Figure 19B:
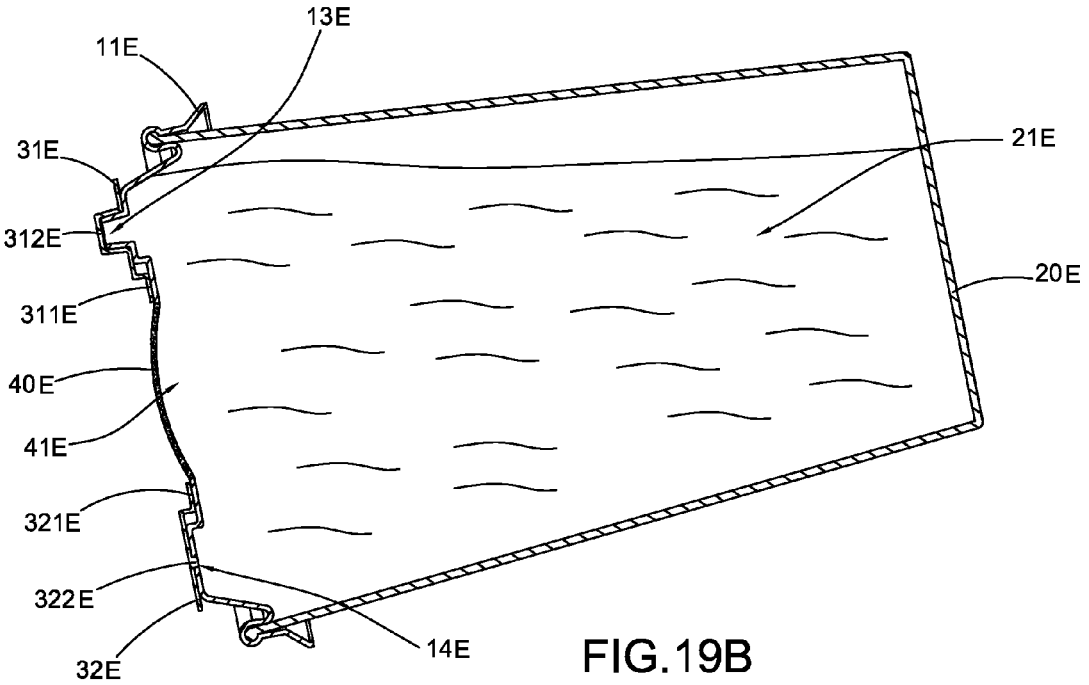
FIG. 19B is a sectional view of a container and a container lid after being filled with liquid in tilted status according to above sixth preferred embodiment of the present invention.
Figure 20:
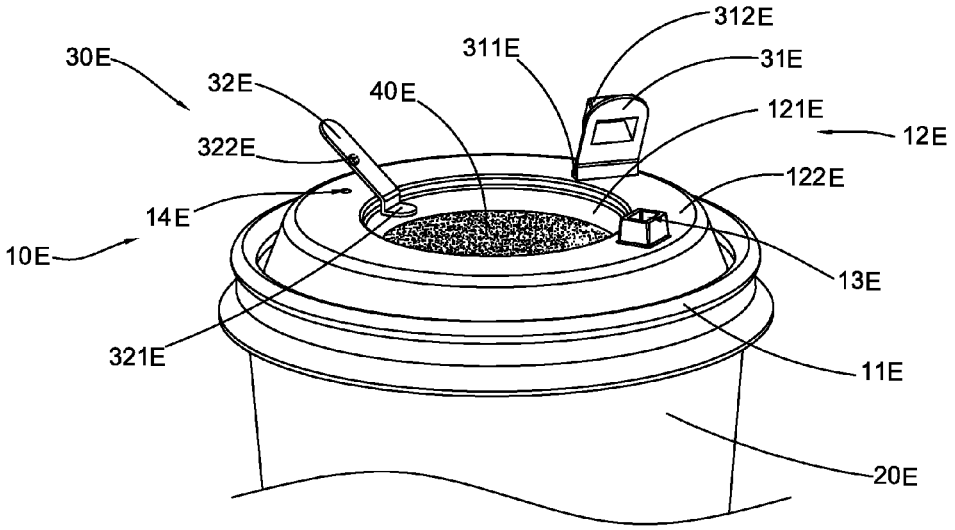
FIG. 20 is a first alternative mode of a container and a container lid according to above sixth preferred embodiment of the present invention.
Figure 21:
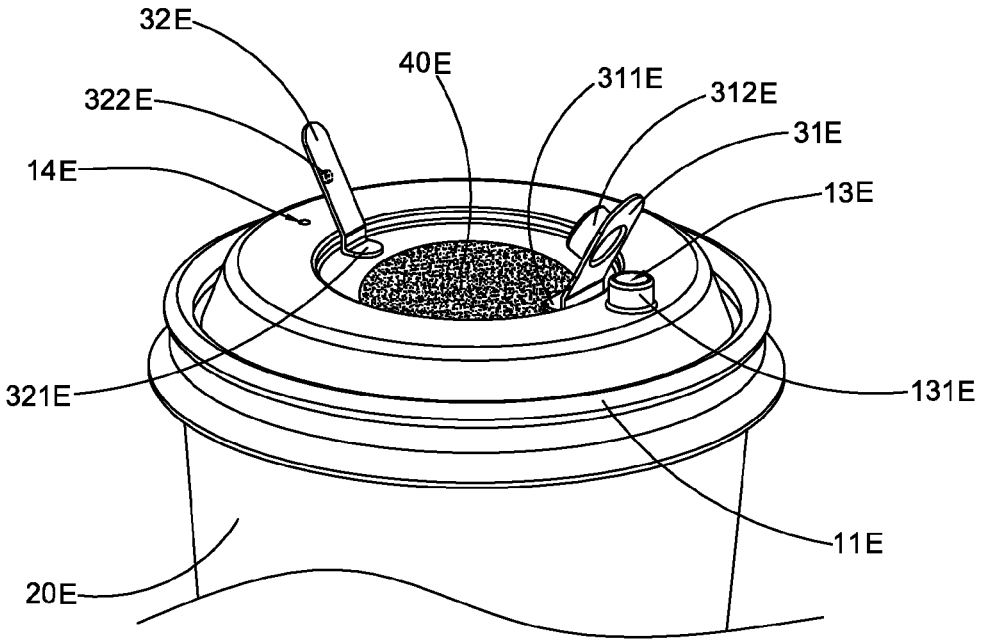
FIG. 21 is a second alternative mode of a container and a container lid according to above sixth preferred embodiment of the present invention.
Figure 22:
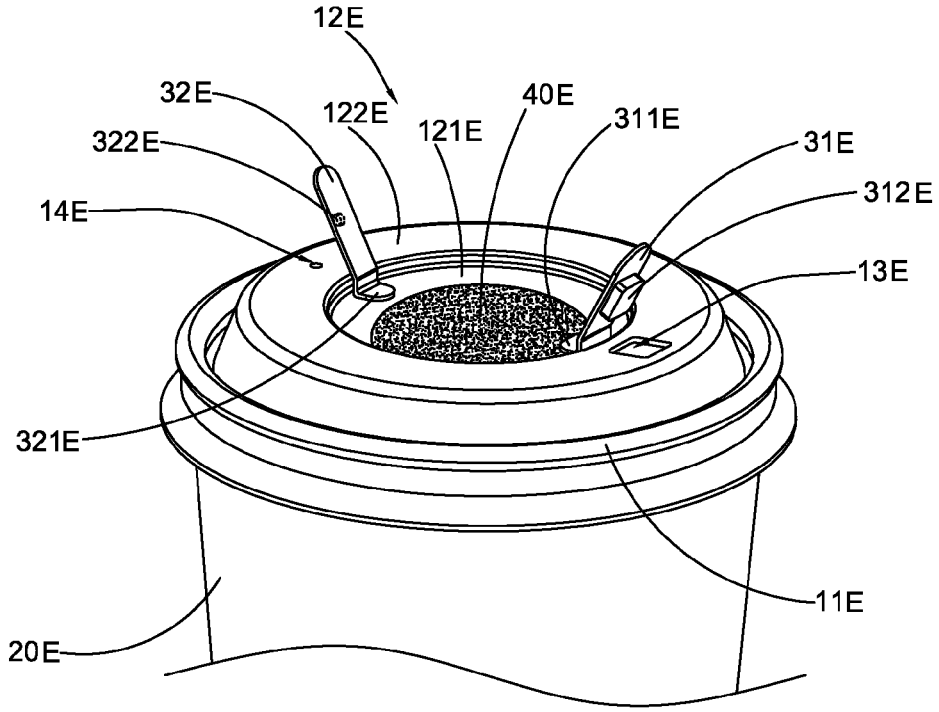
FIG. 22 is a third alternative mode of a container and a container lid according to above sixth preferred embodiment of the present invention.

FIG. 15 illustrates the lid cover 20 formed in different shape. The lid cover 20 can be formed in a rectangular shape to match with the corresponding shape of the top opening of the container 10. Likewise, it is appreciated that the lid cover 20 can be formed in polygonal shape or oval shape to cover the container 10.

It is worth mentioning that the second to fifth embodiments and their alternative modes are the modifications of the first embodiment that the structural features of the first to fifth embodiments are interchangeable. For example, the expansion membranes 26C, 26D can be formed at the lid cover 20 of the first and second embodiments. Likewise, the expansion membranes 26C, 26D can be formed at the lid cover 20 can be formed with the drinking hole plug 31C and the vent plug 33C with the partially detaching feature. The air vent 25C with the air pore feature can be formed at any one of the above mentioned embodiments and their alternatives.

According to the present invention, the lid is manufactured by the following steps.

(1) Form the lid cover 20 with the peripheral sealing edge 21 and the top cover 22. Accordingly, the drinking hole 23 and/or the vent hole 25 can be formed at the same time.

(2) Integrally form the drinking hole plug 31 and the vent plug 33A along the sealing edge 21 of the lid cover 20 at two opposed or distant sides.

(3) Form the tearable lines at the tearable edges 311, 331A of the drinking hole plug 31 and the vent plug 33A respectively. Therefore, the drinking hole plug 31 and the vent plug 33A can be easily detached from the lid cover 20.

In the step (1), the drinking plug pit 32 and/or the vent plug pit 34A can be formed at the top cover 22. In addition, the expansion membrane 26C, 26D can also be formed at the surrounding wall 24 and/or the center lowered platform 222 of the lid cover 20 in the step (1). All the structures of the lid cover 20 with the drinking hole plug 31 and the vent plug 33A can be integrally formed by thermoforming or pressing or even injection.

Referring to FIGS. 16 to 22, a container and a container lid according to a sixth preferred embodiment is illustrated. The container comprises a container lid 10E and a container body 20E, wherein the container lid 10E comprises a sealing portion 11E and the container body 20E comprises a container cavity 21E and a top opening 22E. The sealing portion 11E is provided around the container lid 10E and adapted for connecting the container body 20E. After connection, the top opening 22E of the container body 20E is sealed by the container lid 10E, so that the container cavity 21E is sealed to prevent liquid in the container cavity 21E from leaking.

The container lid 10E further comprises a body portion 12E, wherein the body portion 12E is connected and surrounded by the sealing portion 11E. The body portion 12E comprises a central zone 121E and a marginal zone 122E, wherein the marginal zone 122E is provided between the central zone 121E and the sealing portion 11E to connect each other. It is worth mentioning that the sealing portion 11E, the central zone 121E and the marginal zone 122E can be integral forming or separate forming and then assemble together.

The container lid comprises a drinking hole 13E and an air vent 14E. The drinking hole 13E and the air vent 14E are spaced distributed in the marginal zone 122E, wherein the drinking hole 13E is adapted for users to drink the liquid in the container body 20E while the air vent is used for maintaining and balancing the interior pressure of the container body 20E with the exterior to prevent excessive imbalance.

The present invention further comprises a protective component 30E which is adapted for sealing the drinking hole 13E and the air vent 14E to prevent the leakage of liquid in the container body 20E and make it easier for users to take away the drinks such as milk, tea or other beverages.

In particular, the protective component 30E comprises a first protective member 31E and a second protective member 32E serving as the above mentioned drinking plug and or the vent plug respectively. The first protective 31E comprises a first fixed end 311E and a first sealed end 312E. The first protective member 31E is connected with the container lid 10E through the first fixed end 311E. The size and shape of the first sealed end 312E are matched with that of the drinking hole 13E to seal the drinking hole 13E. The second protective member 32E comprises a second fixed end 321E and a second sealed end 322E. The second protective member 32E is connected with the container lid 10E through the second fixed end 321E. The size and shape of the second sealed end 322E are matched with that of the air vent 14E to seal the air vent 14E.

Preferably, the first fixed end 311E and the second fixed end 312E are adhesive which the bottom is made of viscous material to adapt for adhering to the surface of the container lid 10E. In other words, the first protective member 31E and the second protective member 32E are connected with the container lid 10E through the first fixed end 311E and the second fixed end 321E respectively to seal the drinking hole 13E and the air vent 14E.

When the first protective member 31E is not in use to seal the drinking hole 13E, for example, a customer is using the drinking hole 13E to drink beverage, the first protective member 31E is put on any part aside the drinking hole 13E while the first fixed end 311E is still connected to the container lid 10E. In other word, the customer can move the first protective member 31E to any other parts of the container lid 10E by moving the first fixed end 311E to avoid any interference of the first protective member 31E. When the drinking hole 13E needs to be sealed, the user can move the first fixed end 311E again to seal the drinking hole, in which way to prevent the loss of the first protective member 31E and also can achieve a convenient result of sealing and opening the drinking hole 13E. In addition, since the first fixed end 311E is fixed, the first protective member 31E will not be lost and is able to seal again.

The second protective member 32E is connected to any part on the surface of the container lid 10 through the second fixed end 321E which can be easily moved. Such that the air vent 14E is easy to be opened or sealed.

It is worth mentioning that the first protective member 31E and the second protective member 32E also could be connected to the surface of the container lid 10E through the first fixed end 311E and the second fixed end 321E respectively. In other words, the first protective member 31E and the second protective member 32E are fixedly connected to the container lid 10E.

When the drinking hole 13E is formed by a surrounding wall 131E, in other words, if the surrounding wall 131E of the drinking hole 13E is protruded from the surface of the container lid 10E, then the first sealed end 312E having a recess. The recess is able to receive the surrounding wall 131E of the drinking hole 13E. With the tight connection, the surrounding wall 131E of the drinking hole 13E is tightly connected with the first sealed end 312E, thus the drinking hole 13E is sealed. When the drinking hole 13E is a flat hole on the surface of the container lid 10E, the first sealed end 311E is embodied as a plug which is adapted for sealing the drinking hole 13E to prevent the leakage of the liquid in the container cavity 21E, making it convenient for users to carry.

It is worth mentioning that the drinking hole can be altered such as rectangular, circular or heart shaped. User can drink directly from the drinking hole 13E or use a straw to drink. The size and shape of the air vent 14E can be altered.

The sixth preferred embodiment of the present invention further comprises a expansion membrane 40E. The expansion membrane 40E is provided on the container lid 10E, wherein the expansion membrane is made of thermal expandable material, such as rubber. When not heated, the expansion membrane 40E stays in flat state such as horizontally extended state. When heated, the expansion membrane 40E will expand and bulge upwardly to form an expanded space 41E. The expanded space 41E is connected with the container cavity 21E through the top opening 22E. When steam travels into the expanded space 41E, the air volume of the container body 20E is increased, and the interior pressure is decreased, such that a pressure difference is produced between the interior and exterior pressure of the container. In other word, a negative pressure is produce inside the container which will enhance the containment to make the container lid 10E and the container body 20E seal tightly. When the container is tilted or put upside-down, the expansion membrane is able to prevent liquid leakage to make the container suitable for carrying hot drinks.

Preferably, the expansion membrane 40E and the container lid 10E are integrally manufactured.

Preferably, the expansion membrane 40E is provided in the central zone 121E, located in the middle part of the container lid 10E. When the container is used to fill hot drinks, after the container lid 10E is placed, the expansion membrane 40E is able to expand upwardly to form the expanded space 41E in a semi-spherical shape. In such way, the interior volume of the container is increased, and the interior pressure of the container is less than the exterior pressure to produce a negative pressure inside the container. When the liquid inside the container is cool down, the expansion membrane 40E will shrink to its normal status.

Figure 23:
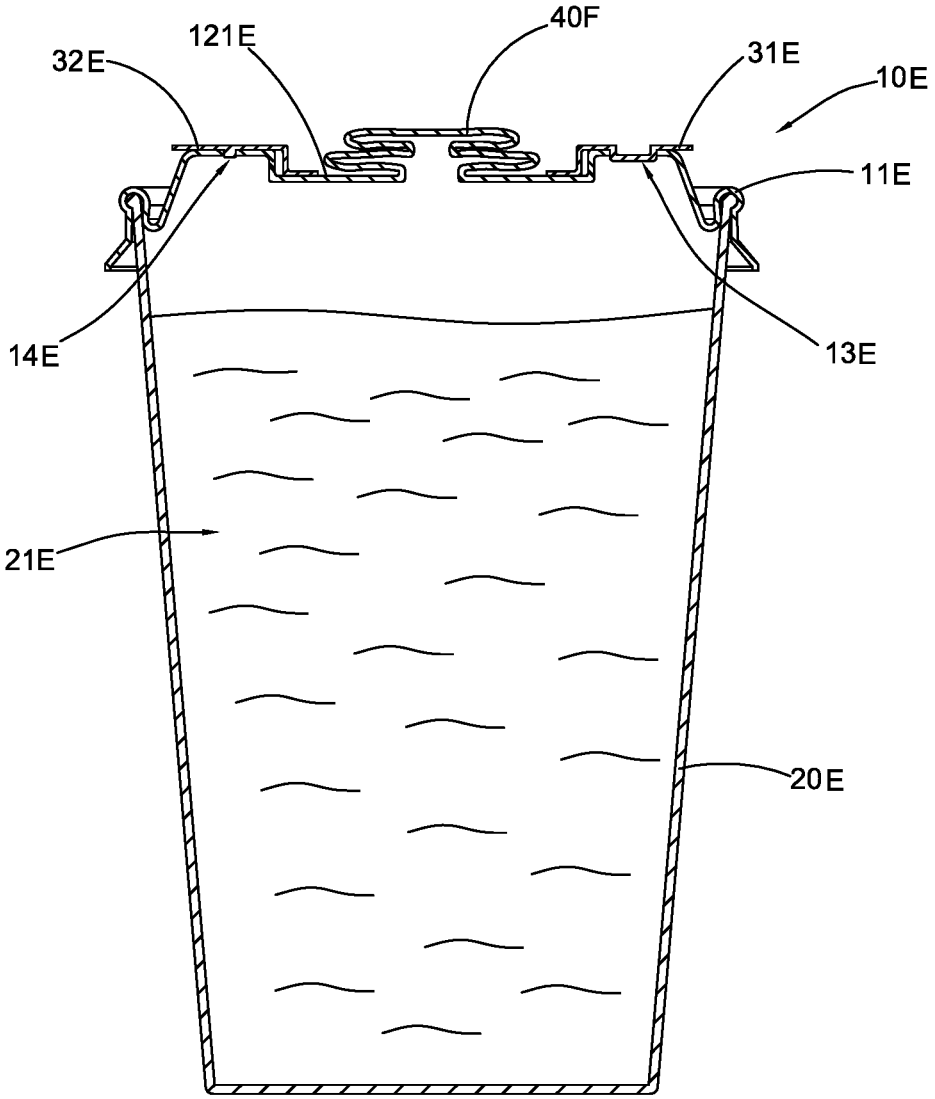
FIG. 23 is a sectional view of a container and a container lid according to a seventh preferred embodiment of the present invention.
Figure 24:
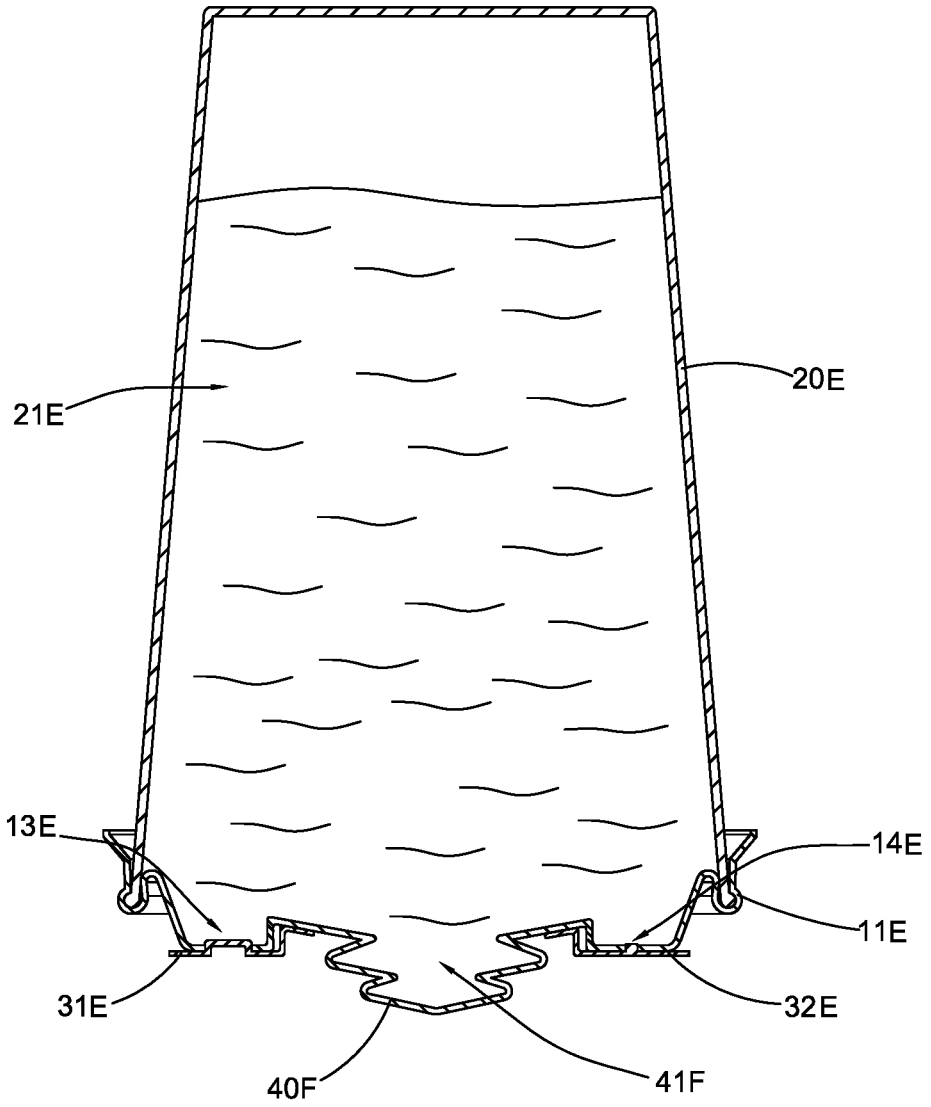
FIG. 24 is a sectional view of a container and a container lid after being filled with liquid in upside-down status according to above seventh preferred embodiment of the present invention.

Referring to FIGS. 23 and 24, a seventh preferred embodiment of the present invention illustrates another alternative mode of the sixth embodiment, which is a modification and improvement of the container lid 10E in the first preferred embodiment. Wherein an expansion membrane 40F is provided in the central zone 121E. Preferably, the expansion membrane has a gyro-shaped multi-layer structure and made of thermal expandable material. When not heated, the expansion membrane 40F has two layers and a small expanded space 41F. When heated, the expansion membrane 40F will expand and bulge upwardly to form a gyro-shaped expanded space 41F. The expanded space 41F is connected with the container cavity 21E. When steam travels into the expanded space 41F, the air volume of the container body 20E is increased, and the interior pressure is decreased, such that a negative pressure is produce inside the container which will prevent liquid leakage to make the container secure and convenient for carrying hot drinks.

Figure 25:
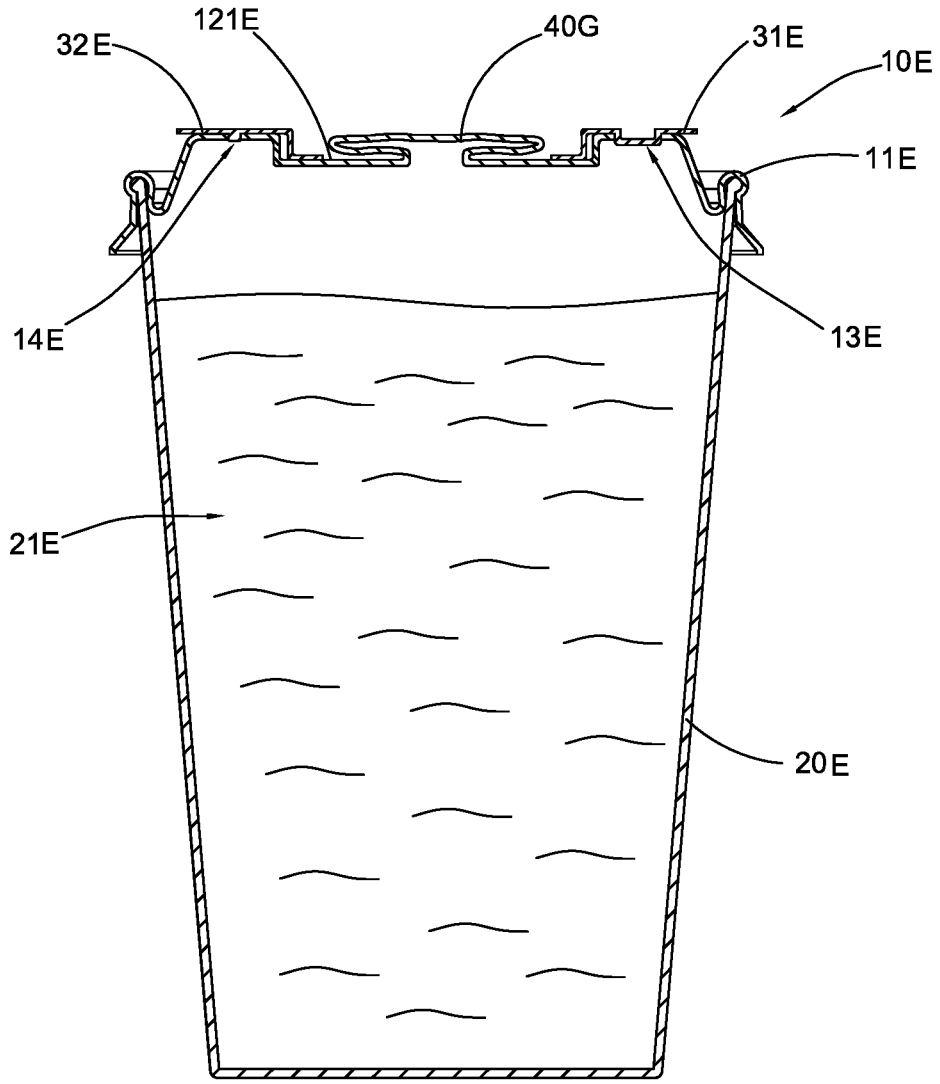
FIG. 25 is a first alternative mode of a container and a container lid according to above seventh preferred embodiment of the present invention.
Figure 26:
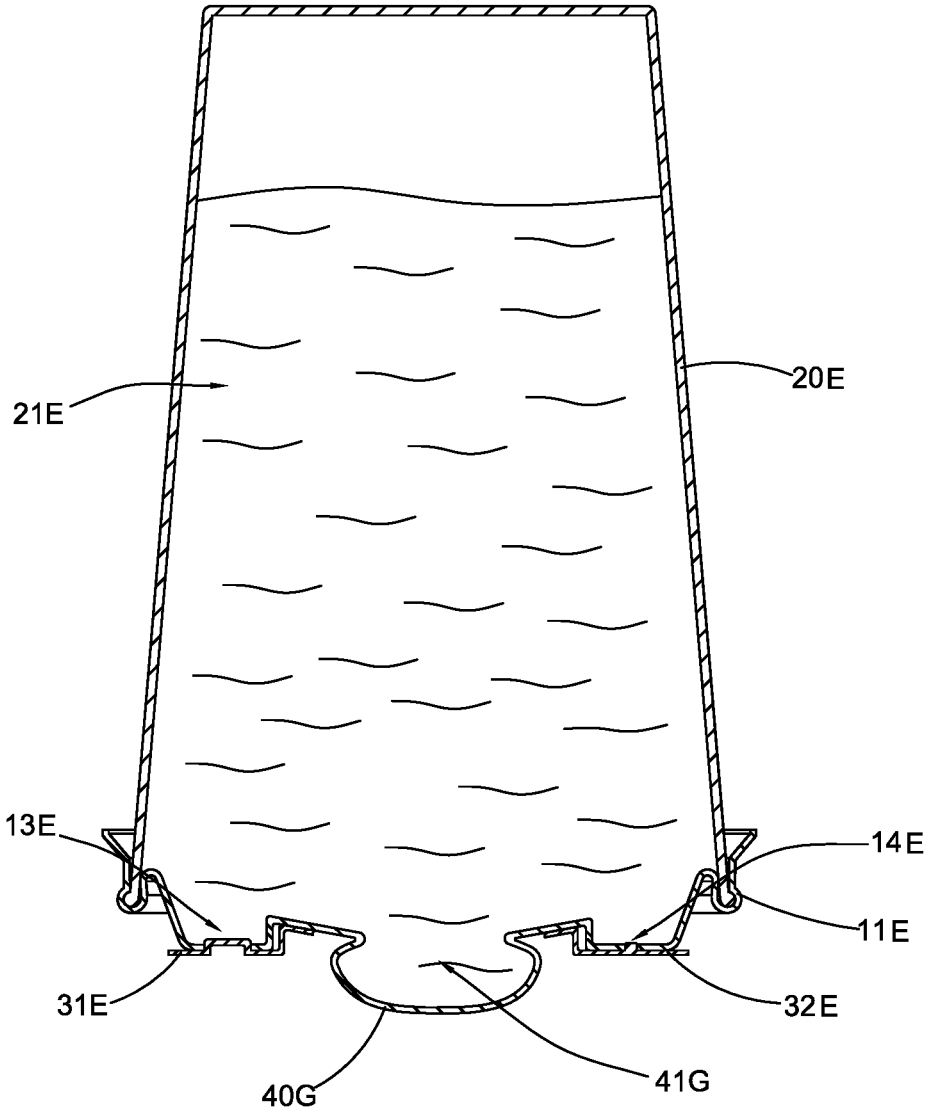
FIG. 26 is a second alternative mode of a container and a container lid according to above seventh preferred embodiment of the present invention.

Referring to FIGS. 25 and 26, an alternative of the seventh preferred embodiment of the present invention is illustrated. An expansion membrane 40G is provided in the central zone 121E, wherein the expansion membrane 40G has a gyro-shaped single-layer structure and made of thermal expandable material. When heated, the expansion membrane 40G will expand and bulge upwardly to form a gyro-shaped expanded space 41G. The expanded space 41G is connected with the container cavity 20E. When steam travels into the expanded space 41G, the air volume of the container body 20E is increased, and the interior pressure is decreased, such that a negative pressure is produce inside the container which will prevent liquid leakage to make the container secure and convenient for carrying hot drinks.

Figure 27:
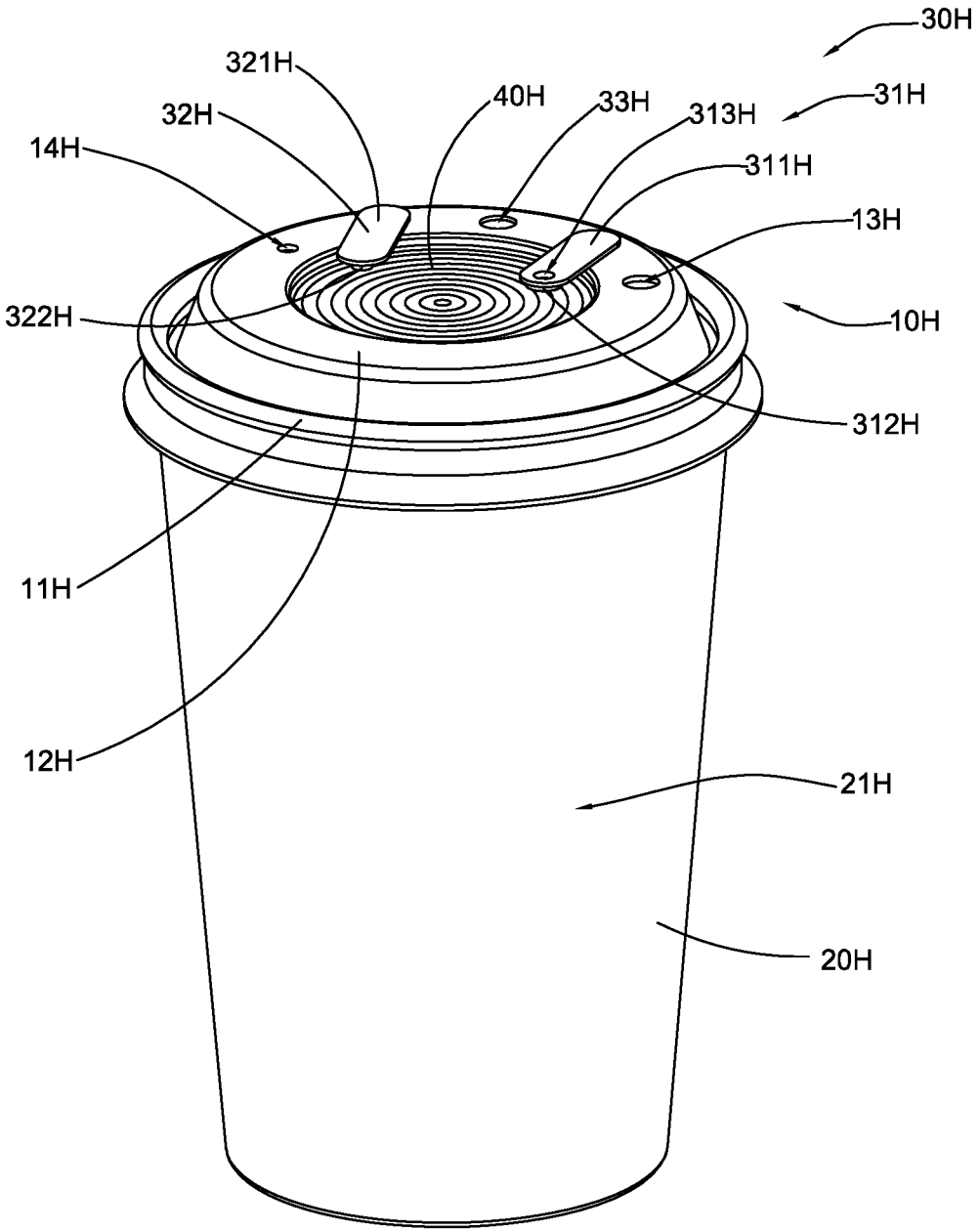
FIG. 27 is a structural diagram of a container and a container lid according to an eighth preferred embodiment of the present invention.
Figure 28:
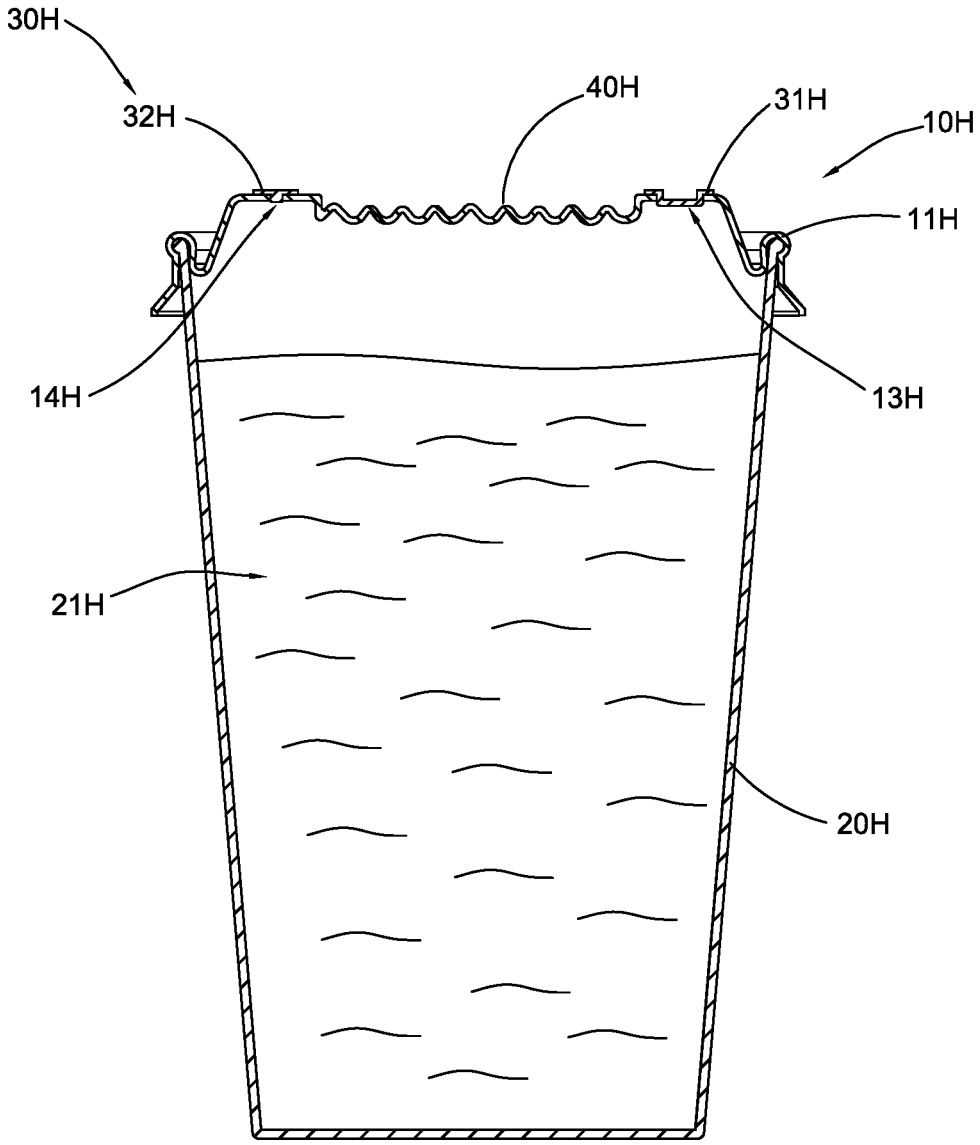
FIG. 28 is a sectional view of a container and a container lid according to above eighth preferred embodiment of the present invention.
Figure 29:
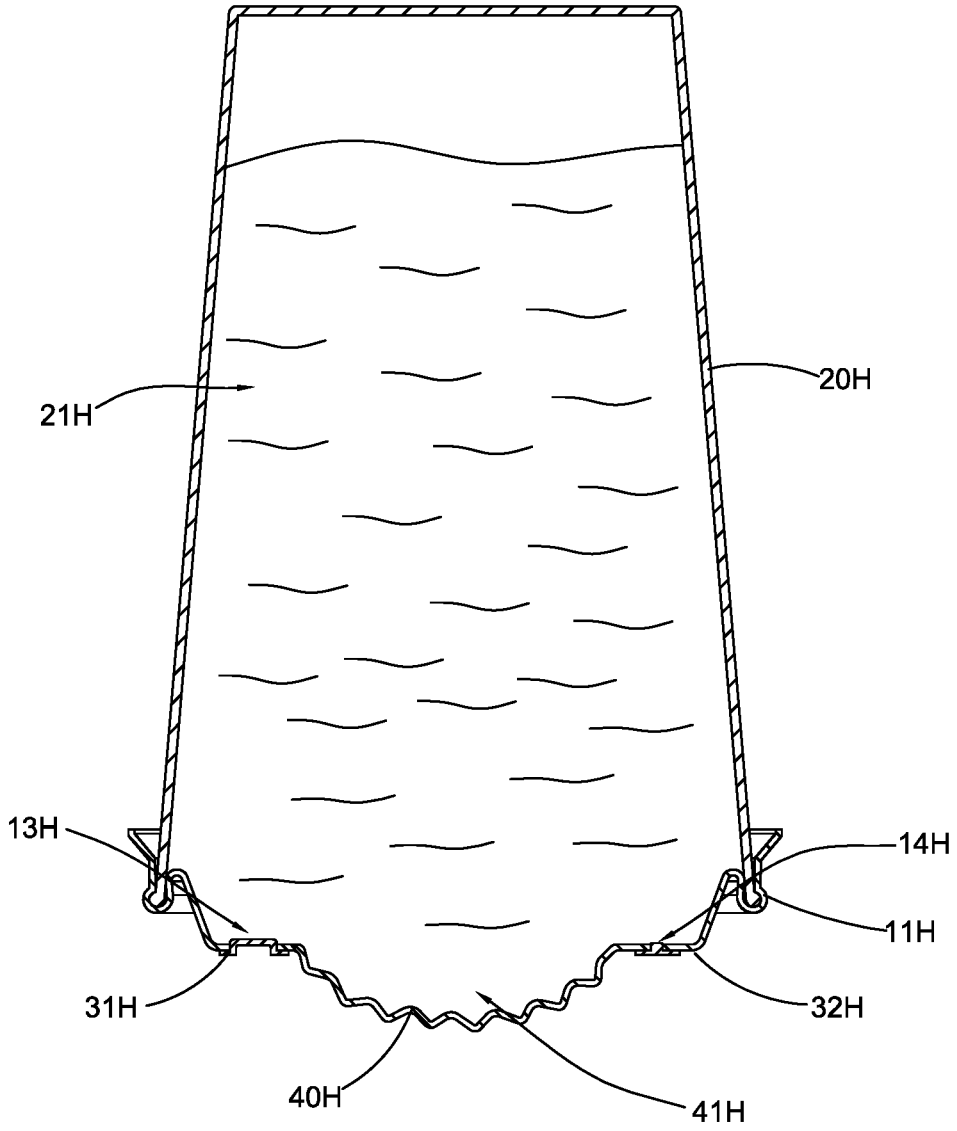
FIG. 29 is a sectional view of a container and a container lid after being filled with liquid in upside-down status according to above eighth preferred embodiment of the present invention.

Referring to FIGS. 27 to 29, a container and a container lid according to an eighth preferred embodiment is illustrated. The container comprises a container lid 10H and a container body 20H, wherein the container lid 10H comprises a sealing portion 11H and a body portion 12H. The sealing portion 11H is provided around the container lid 10H and adapted for connecting the container body 20H to enclose the container cavity 21H. The container lid 10H is provided with a drinking hole 13H and an air vent 14H, wherein the drinking hole 13H and the air vent 14H are provided on the opposite side of the edge of the body portion 12H of the container lid 10H.

According to the third preferred embodiment of the present invention, the invention further comprises a protective component 30H and an expansion membrane 40H. The protective component 30H comprises a first protective member 31H and a second protective member 32H. the first protective member 31H is adapted for sealing the drinking hole 13H and the second protective member 32H is adapted for sealing the air vent 14H when the container is tilted or put upside-down.

Furthermore, the first protective member 31H comprises a first fixed end 311H and a first sealed end 312H, wherein the first fixed end 311H and the first sealed end 312H are provided on the opposite end of the first protective member 31H. The second protective member 32H comprises a second fixed end 321H and a second sealed end 322H, wherein the second fixed end 321H and the second sealed end 322H are provided on the opposite end of the second protective member 32H. The first protective member 31H is movably connected with the surface of the container lid 10H through the first fixed end 311H, wherein the first protective member 31H is able to rotate around the first fixed end 311H on the container lid 10H to change the mutual position of the first protective member 31H on the container lid 10H, making it easy for user to drink. The first fixed end 312H is embodied as a plug which has a shape and size matched with that of the drinking hole 13H to seal the drinking hole 13H. The second fixed end 321H is rotatably connected to the surface of the second protective member 32H, and able to rotate around the container lid 10H to change the mutual position of the second protective member 32H on the container lid 10H. The second sealed end 322H is embodied as a plug which has a shape and size matched with that of the air vent 14H to seal the air vent 14H.

The container lid 10H further comprises a restraint slot 33H. Preferably, the restraint slot 33H is provided on the container lid 10H and spaced arranged with the drinking hole 13H and the air vent 14H, wherein the size and shape of the restraint slot 33H matches that of the first sealed end 312H to receive the first sealed end 312H. When the first fixed end 312H is not in use to seal the drinking hole 13H, the first fixed end 312H is put in the restraint slot 33H. In other word, the user can rotate the first protective member 31H around the first fixed end 311H to the restraint slot 33H, so that the first sealed end 312H is put in the restraint slot 33H to fix the first protective member 31H, avoiding any interference of the first protective member 31H.

In addition, a retaining slot 313H is provided on one end of the first protective member 31H, wherein the retaining slot 313H and the first sealed end 312H are arranged on opposite side of the same end of the first protective member 31H, and the size and shape of the retaining slot 313H is adapted to that of the second sealed end 322H to receive the second sealed end 322H. When the first sealed end 312H is located in the restraint slot 33H, user can rotate the second protective member 32H to posit the second sealed end 322H upon the restraint slot 33H and then locate the second sealed end 322H in the retaining slot 313H. In other words, user inserts the second sealed end 322H into the retaining slot 313H to fix the second protective member 32H. When the air vent 14H needs to be sealed, the user can unplug the second sealed end 322H and rotate the second fixed end 321H to seal the air vent 14H with second sealed end 322H.

The expansion membrane 40H is arranged in the middle part of the container lid 10H, which is made of thermal expandable material. Wherein the expansion membrane 40H has a multi-turn corrugated structure which is arranged transversely, such as horizontally arranged as shown in the figure. When the container is filled with hot drinks, the expansion membrane 40H will expand and bulge upwardly to form an expanded space 41H. When steam travels into the expanded space 41H, the air volume of the container is increased, and the interior pressure is decreased, such that a pressure difference is produced between the interior and exterior pressure of the container. In other word, a negative pressure is produce inside the container which will enhance the containment to make the container lid 10H and the container body 20H seal tightly. When the container is tilted or put upside-down, the expansion membrane is able to prevent liquid leakage to make the container suitable for carrying hot drinks.

Figure 30:
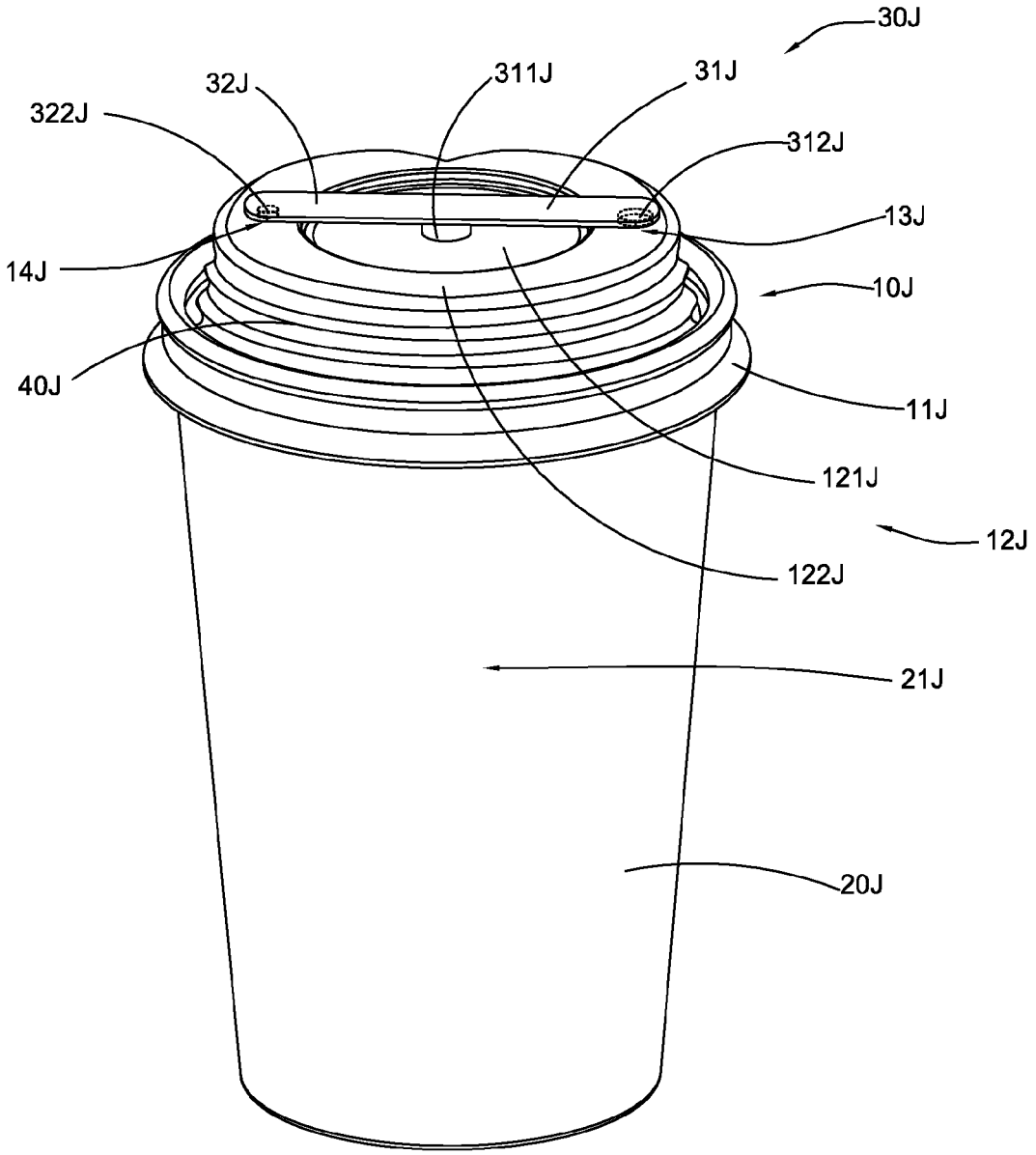
FIG. 30 is a structural diagram of a container and a container lid according to a ninth preferred embodiment of the present invention.
Figure 31:
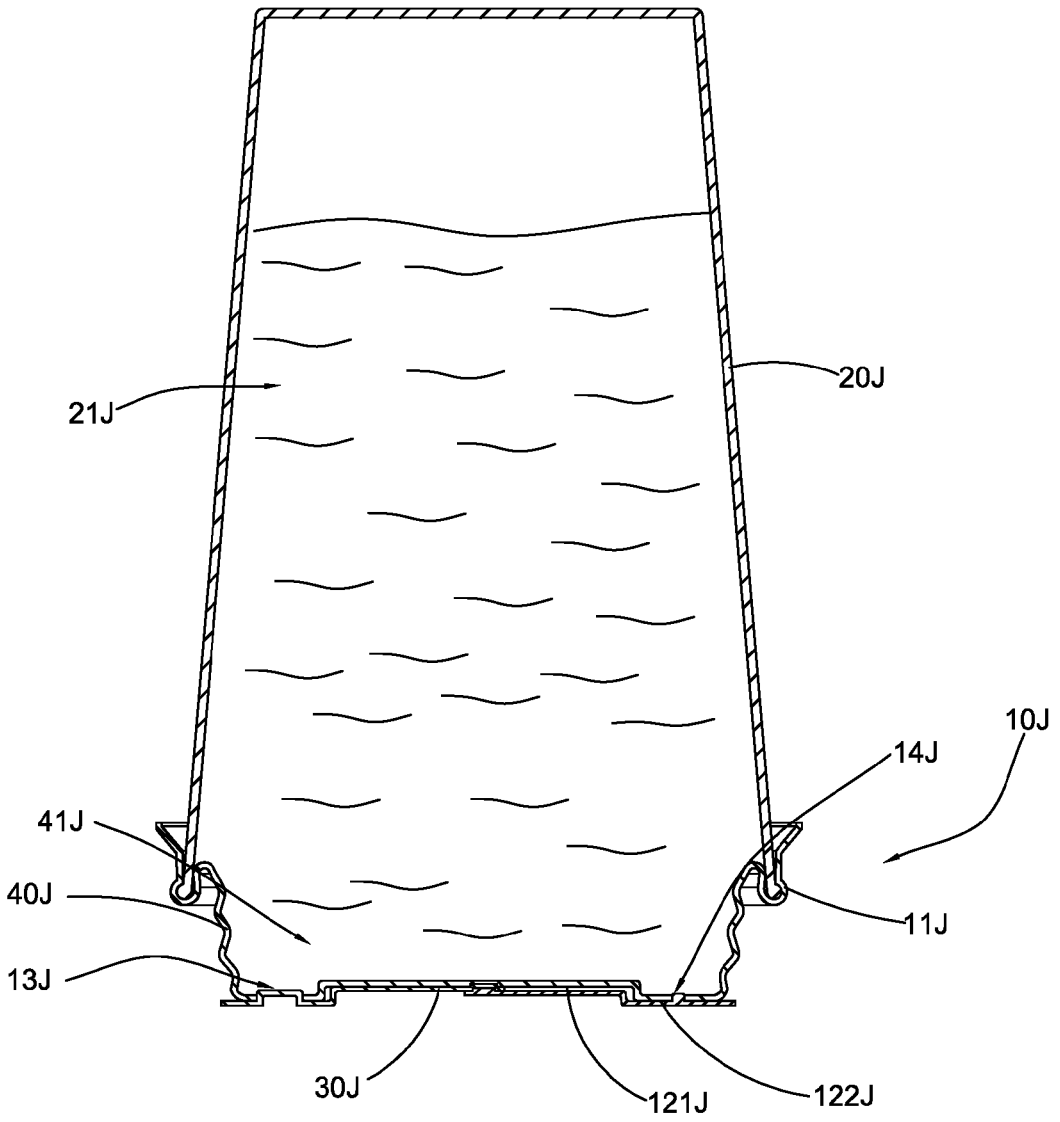
FIG. 31 is a sectional view of a container and a container lid according to above ninth preferred embodiment of the present invention.

Referring to FIGS. 30 and 31, a ninth preferred embodiment of the present invention is illustrated. The container comprises a container lid 10J, wherein the container lid 10J which has a heart shape comprises a sealing portion 11J and a body portion 12J. The sealing portion 11J is adapted for connecting the container lid 10J and the container body 20J to prevent the leakage of the container from the container cavity 21J thereof. The sealing portion 11J is arranged on the peripheral part of the body portion 12J. furthermore, the body portion 12J comprises a central zone 121J and a marginal zone 122J, wherein the central zone 121J is arranged in the center part of the container lid 10J, and the marginal zone 122J is arranged to connect the central zone 121J and the sealing portion 11J.

The container lid 10J is provided with a drinking hole 13J and an air vent 14J, wherein the drinking hole 13J and the air vent 14J are provided on the opposite end of the marginal zone 122J.

The invention further comprises a protective component 30J which comprises a first protective member 31J and a second protective member 32J, wherein the first protective member 31J comprises a first fixed end 311J and a first sealed end 312J, and the second protective member 32J comprises a second sealed end 322J. the first fixed end 311J is used to connect one end of the first protective member 31J and the second protective member 32J together with the center part of the central zone 121J. The first sealed end 312J and the second sealed end 322J is arranged at the end of the first protective member 31J and the second protective member 32J respectively, and coupled with the first fixed end 311J and the second fixed end 312J, wherein one end of the first protective member 31J and the second protective end 32J extends to the drinking hole 13J and the air vent 14J to detachably seal the drinking hole 13J and the air vent 14J. in other words, the size and shape of the first sealed end 312J and the second sealed end 322J is adapted to that of the drinking hole 13J and the air vent 14J to removably insert into the drinking hole 13J and the air vent 14J respectively.

The invention further comprises an expansion membrane 40J, wherein the expansion membrane 40J has a multi-layer corrugated structure which is arranged between the sealing portion 11J and the body portion 12J. In other words, the expansion membrane 40J is arranged on the peripheral part of the container lid 10J. in particular, the expansion membrane 40J is connected with the sealing portion 11J and the marginal zone 112J of the body portion 12J, wherein the expansion membrane 40J is made of thermal expandable material. When heated, the expansion membrane 40J will expand and bulge upwardly as shown in the figures to form an expanded space 41J which increased the height of the container lid 10J. When steam travels into the expanded space 41J, the air volume of the container is increased, and the interior pressure is decreased, such that a pressure difference is produced between the interior and exterior pressure of the container. In other word, a negative pressure is produce inside the container which will enhance the containment to make the container lid 10J and the container body 20J seal tightly. When the container is tilted or put upside-down, the expansion membrane is able to prevent liquid leakage to make the container suitable for carrying hot drinks.

It is worth mentioning that the shape of the container lid 10J and the container body can be altered. The container lid 10J and the container body 20J uses circular or a heart shaped structure is only mentioned as an example but not limited to these. The container could be made in to any other shape such as a rectangular shape.

Figure 32:
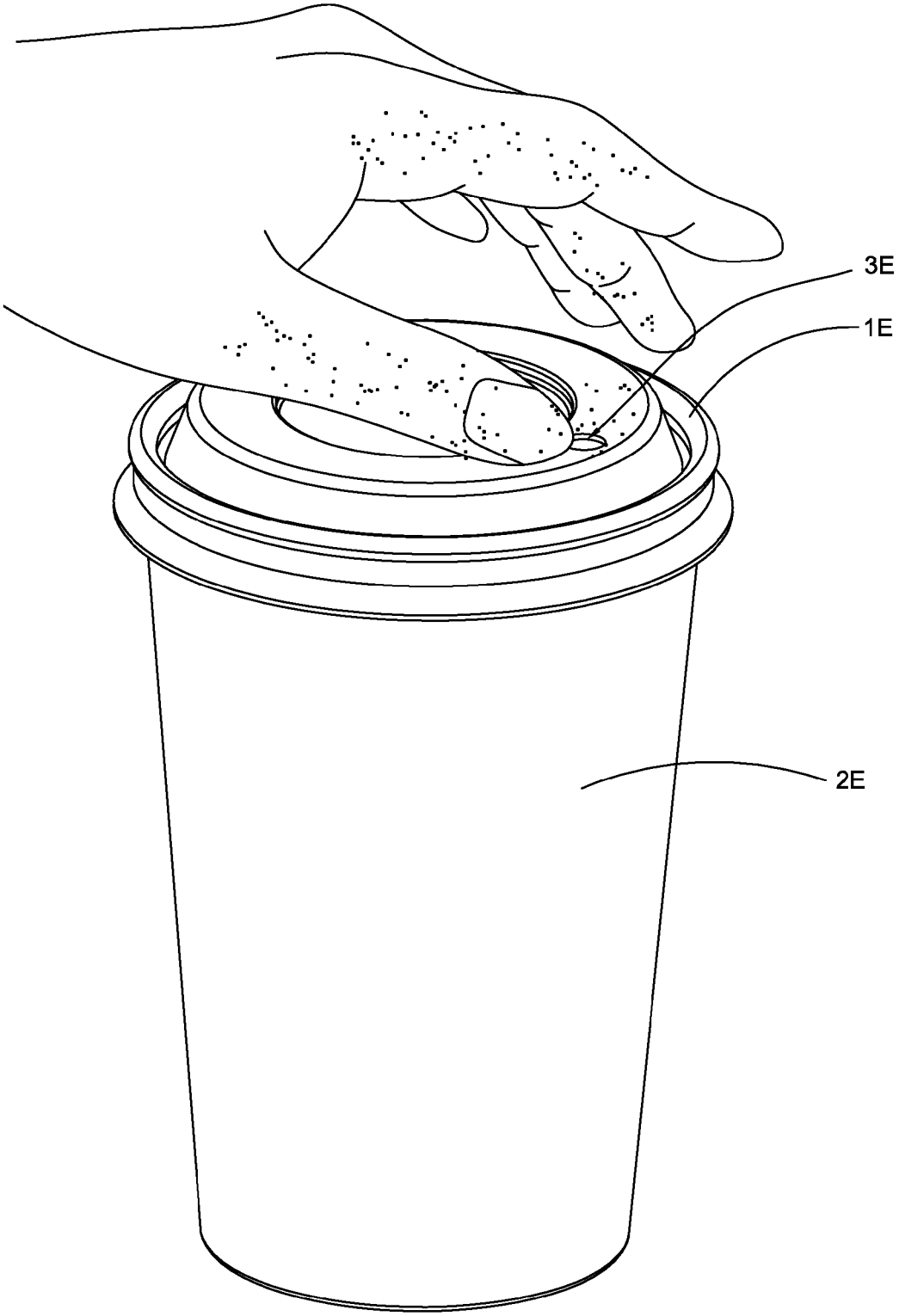
FIG.32 ( PRIOR ART)
FIG. 32 is a structural diagram of a conventional container and a conventional container lid.
Figure 33:
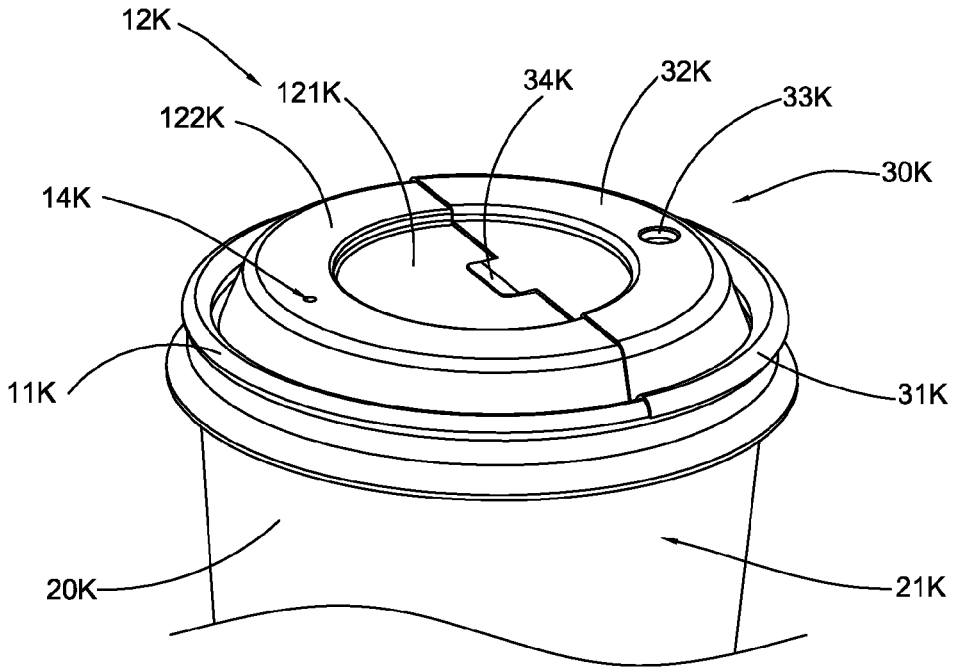
FIG. 33 is a structural diagram of a container and a container lid according to a tenth preferred embodiment of the present invention.

Referring to FIG. 32, a conventional container lid is illustrated. When a customer orders a drink, shop staff such as a barista or a cashier will get the hot drinks and seal the container body 2E using a container lid 1E with their hands to prevent drinks from spilling out and to make it easier for customer to drink. In the process that the staff sealing the container with the container lid 1E, their hands will directly touch the drinking hole 3E on the lid and area around. And this action will bring bacteria to the drinking hole 3E. When customers use the drinking hole 3E to drink hot drinks, it is inevitably their mouths will in contact with the drinking hole 3E or the area around the drinking hole 3E. Thus, bacteria will be drank together with beverage, which is insanitary and could be dangerous to customers.

To solve the above mentioned problem, the present invention proposes a solution. Referring to FIGS. 33 to 38, a tenth preferred embodiment and its alternative modification of the present invention is illustrated.

Referring to FIGS. 33 to 36, the container comprises a container lid 10K which further comprises a sealing portion 11K and a body portion 12K, wherein the sealing portion 11K is arranged on the peripheral part of the body portion 12K. The sealing portion 11K is adapted for connecting the container lid 10K and the container body 20K to prevent the leakage of the container from the container cavity 21K thereof. Furthermore, the sealing portion 12K comprises a central zone 121K and a marginal zone 122K, wherein the central zone 121K is arranged in the center part of the container lid 10K, and the marginal zone 122K is arranged between the central zone 121K and the sealing portion 11K to connect the central zone 121K and the sealing portion 11K. the central zone 121K, the marginal zone 122K and the sealing portion 11K is integrally forming.

The container lid 10K is provided with a drinking hole 13K and an air vent 14K, wherein the drinking hole 13K and the air vent 14K are spacedly arranged on the marginal zone 122K for user to drink and balance the pressure.

The container further comprises a protective cover 30K which has a similar shape as the container lid 10E and a half size as the container lid 10K to cover the container lid 10K and protect the drinking hole 13K and area around. In other words, the protective cover 30E serves as a first protective member 31K and covers the drinking hole 13K and area around. When the shop staff fill the container, he or she will touch the protective cover 30K instead of the drinking hole 13K or area around the drinking hole 13K, such that the drinking hole 13K will not be contaminated with bacteria and viruses and cross-infection will be prevented.

In particular, the protective cover 30K comprises a sealing part 31K and a body part 32K, wherein the size and shape of the sealing part 31K is adapted with that of the container lid 11K while the size and shape of the body part 32K is adapted with that of the body portion 12K to make the protective cover 30K tightly cover the outer surface of the container lid 10K with better appearance.

The protective cover 30K further comprises a sealing member 33K, wherein the sealing member 33K is arranged on the corresponding surface of the protective cover 30K and the container lid 10K. the sealing member is embodied as a plug which has a size and shape adapted with the drinking hole 13K to removably seal the drinking hole 13K, such that the drinking hole 13K is sealed to prevent the liquid spilling from the drinking hole 13K. when a user wants to drink, remove the sealing member 33K from the drinking hole 13K, or the user can use a straw to drink from the drinking hole 13K.

The protective cover 30K further comprises a fixing member 34K which is arranged on the middle of the margin of the body portion 32K to connect the protective cover 30E and the center part of the central zone 121K, so that the protective cover 30E is pivotally folded to cover on the container lid 10K. When the protective cover 30K is open to use, the fixing member 34K is used to fix the protective cover 30E to prevent loss.

It is worth mentioning that the fixing member 34K is embodied as adhesive member which has a viscous bottom to detachably attach the protective cover 30K to the container lid 10K. or the fixing member 34K can be heat sealed to the container lid 10K.

Figure 34:
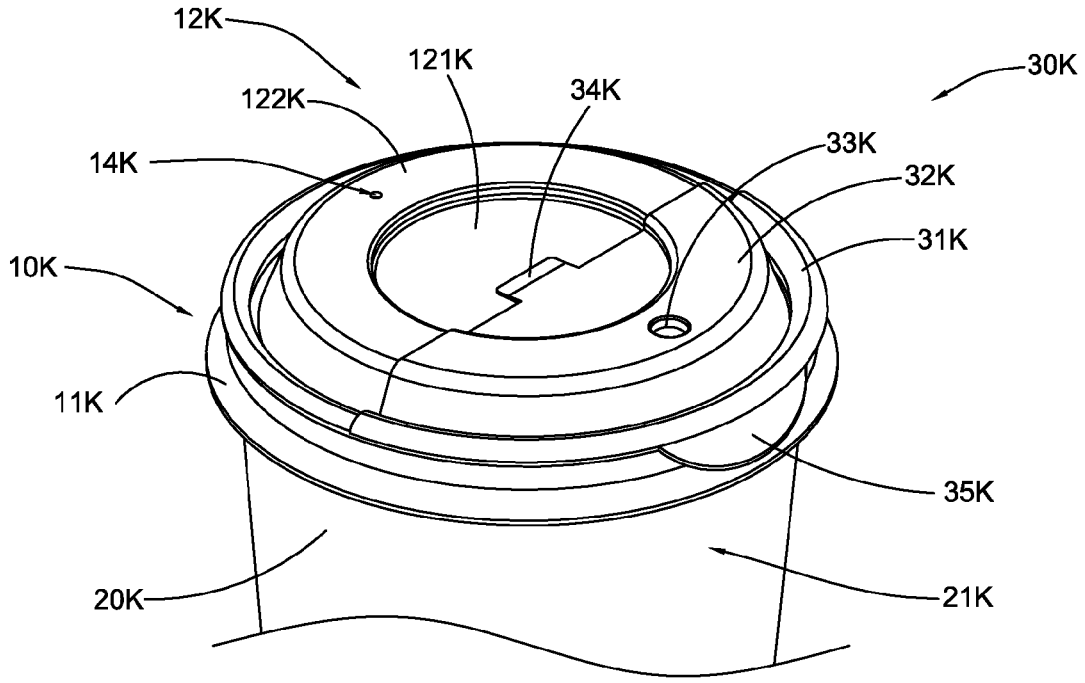
FIG. 34 is a first alternative mode of a container and a container lid according to above tenth preferred embodiment of the present invention.
Figure 35:
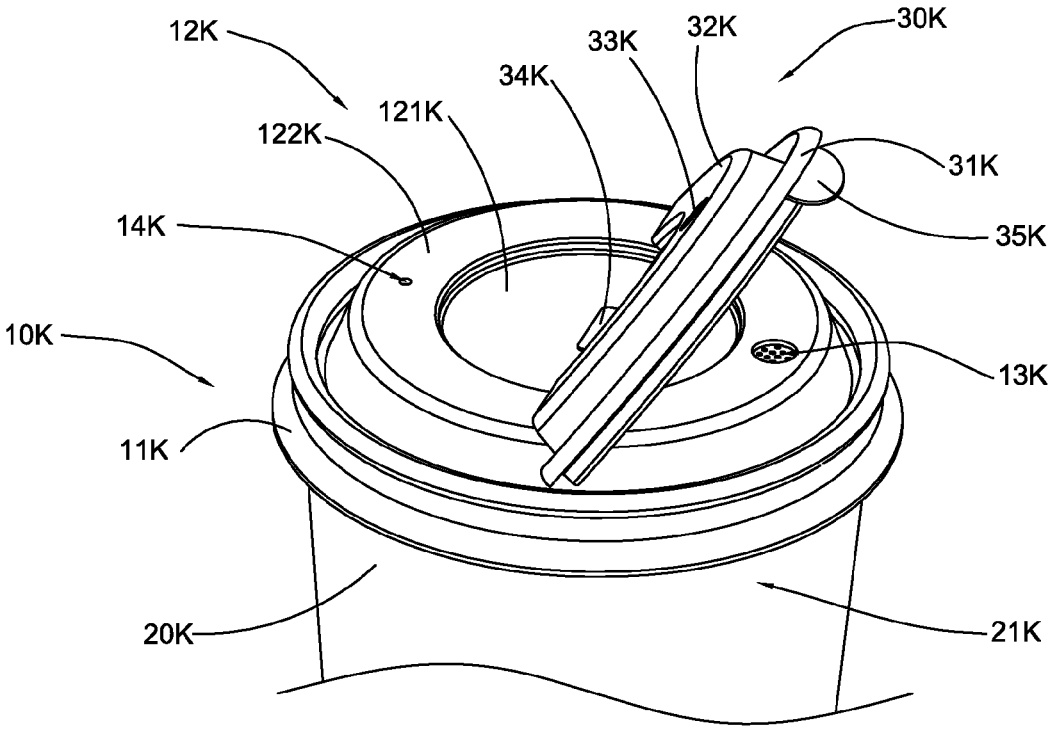
FIG. 35 illustrates a container lid in open status according to above tenth preferred embodiment of the present invention.
Figure 36:
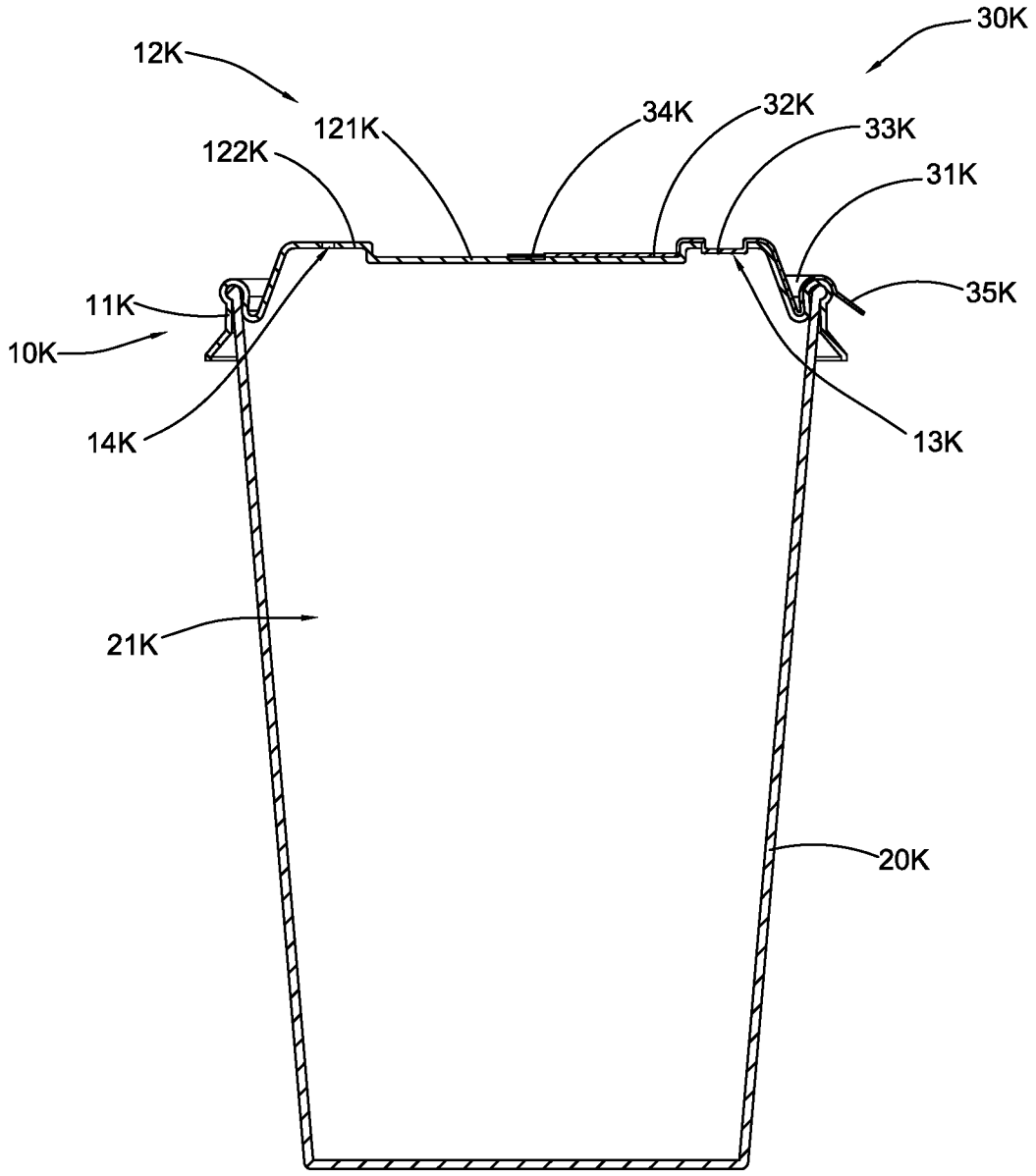
FIG. 36 is a sectional view of a container and a container lid according to above tenth preferred embodiment of the present invention.

Referring to FIGS. 34 to 36, the protective cover 30K further comprises an operating member 35K, wherein the operating member 35K is arranged on the sealing portion 31K. The operating member 35K is formed by extending outwardly from the edge of the sealing member 31K and distant from the sealing portion 11K for the customer to use. In other words, the customer is able to open the protective cover 30K easily by operate the operating member 35K in order to separate the sealing member 33K and the drinking hole 13K.

Preferably, the operating member 35K is embodied as a handle in the preferred embodiment. The customer uses the handle to separate the sealing member 33K and the drinking hole 13K, and then use the sealing member 33K to seal the drinking hole 13K, so that the drinking hole 13K and the surrounding area is protected from contaminating bacteria when the customer opens the protective cover 30K with his or her hands.

It is worth mentioning that the protective cover 30K can be made of rigid material or soft material, such as plastic, membrane or the same material as the container lid 10K. And the thickness of the protective cover 30K can be altered according to different demands where transparent or opaque material could be used.

The drinking hole 13K can be implemented as a large hole which adapted for inserting a strew or embodied as multiple air pores. In the preferred embodiment of the present invention, the drinking hole is embodied as multiple air pores which are adapted for inserting a straw. And the sealing member 33K is adapted for protecting the drinking hole 13K to avoid infection and stay sanitary.

In addition, the air vent can be implemented as a large hole or multiple air pores, wherein the air vent 14K is embodied as multiple air pores in the embodiment. Each of the air pores are relatively small and spacedly connected to each other which allows the internal space of the container cavity 21K connected with the external space and prevents the liquid in the container cavity 21K from spilling out from the air vent 14K.

Figure 37:
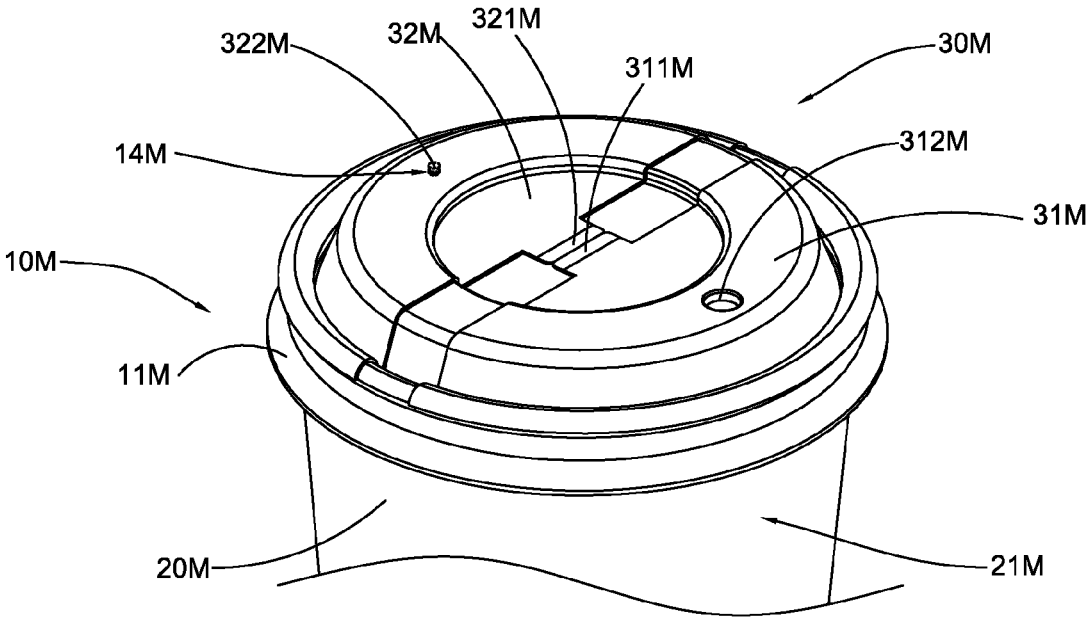
FIG. 37 is a second alternative mode of a container and a container lid according to above tenth preferred embodiment of the present invention.
Figure 38:
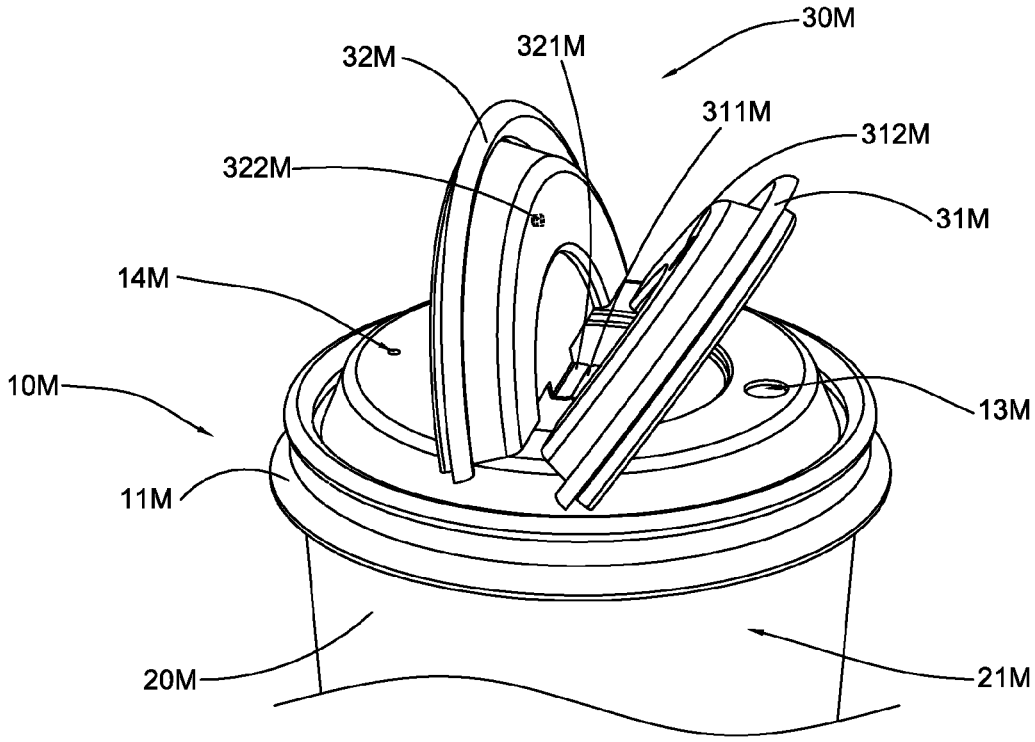
FIG. 38 is a third alternative mode of a container and a container lid according to above tenth preferred embodiment of the present invention.

Referring to FIGS. 37 and 38, an alternative modification of the tenth preferred embodiment of the present invention is illustrated. The container lid 10M and the container body 20M, having the container cavity 21M, are the same as that of the fifth embodiment. The container further comprises a protective component 30M, wherein the protective component 30M comprises a first protective member 31M and a second protective member 32M. The first protective member 31M and the second protective member 32M are both implemented as a protective cover as that in the fifth preferred embodiment which have the same shape of the container lid 10M and cover half of the container lid respectively, such that the drinking hole 13M, the air vent 14M and surrounding area are covered which prevent the cross-infection and secure the safety of the customer. By sealing the drinking hole 13M and the air vent 14M, the leakage of the container is prevented.

The first protective member 31M comprises a first fixed end 311M and a first sealed end 312M. The first fixed end 311M is used to fix the first protective member 31M to the container lid 10M. The size and shape of the first sealed end 312M is adapted to that of the drinking hole 13M, wherein the first sealed end 312M is implemented as a plug to seal the drinking hole by inserting into the drinking hole 13M. The second protective member 32M comprises a second fixed end 321M and a second sealed end 322M. The second fixed end 321M is used to fix the second protective member 32M to the container lid 10M. The size and shape of the second sealed end 322M is adapted with that of the air vent 14M which is implemented as a plug in the embodiment to seal the air vent 14M by inserting into the air vent 14M.

Figure 39:
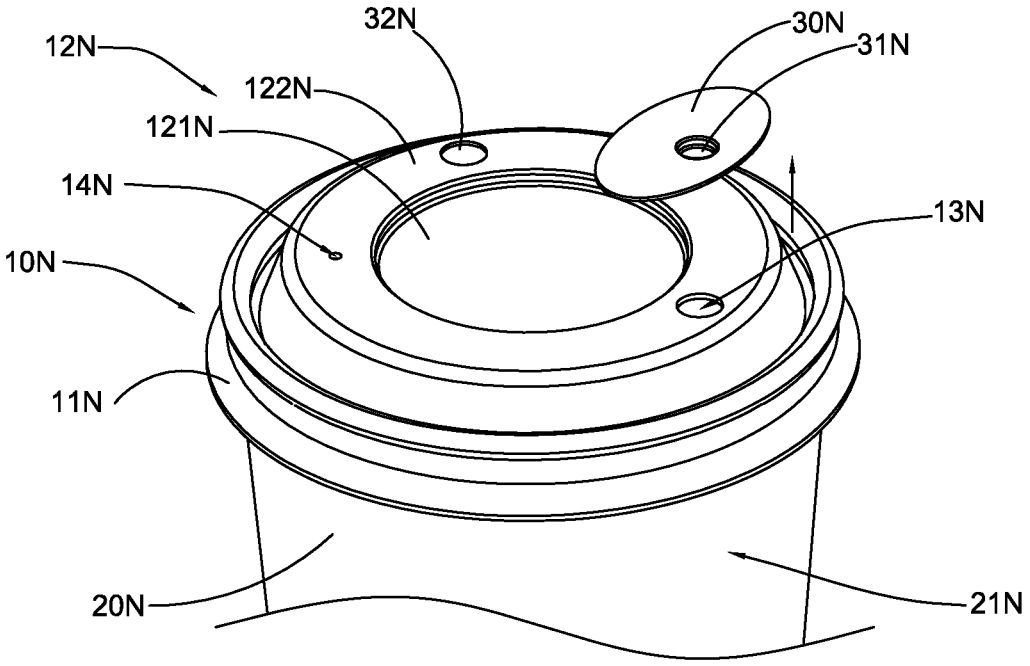
FIG. 39 is a structural diagram of a container and a container lid according to an eleventh preferred embodiment of the present invention.

Referring to the FIG. 39, an eleventh preferred embodiment of the present invention is illustrated. The container further comprises a protective cover 30N which is implemented as a cover with a predetermined shape such as a circle, an oral, a rectangle or any other shape, in order to cover most of the drinking hole 13N and surrounding area, such that the drinking hole 13N and surrounding area is protected to avoid bacteria contamination or any other cross-infection.

The protective cover 30N further comprises a sealing part 31N, wherein the size and shape of the sealing part 31N is adapted with that of the drinking hole 13N to seal the drinking hole 13N by inserting the sealing part 31N into the drinking hole 13N and prevent liquid leakage of the container cavity 21N.

The container lid 10N further comprises a restraint slot 32N, wherein the size and shape of the restraint slot 33N matches that of the sealing member 31N to receive the sealing member 31N. when the customer uses the drinking hole 13N to drink, the customer only needs to open the sealing member 31N to open the protective cover 30N and then insert the sealing member 31N into the restraint slot 32N to prevent loss. When the drinking hole 13N needs to be sealed, the customer simply unplug the sealing member 31N from the restraint slot 32N to seal the drinking hole 13N.

Figure 40:
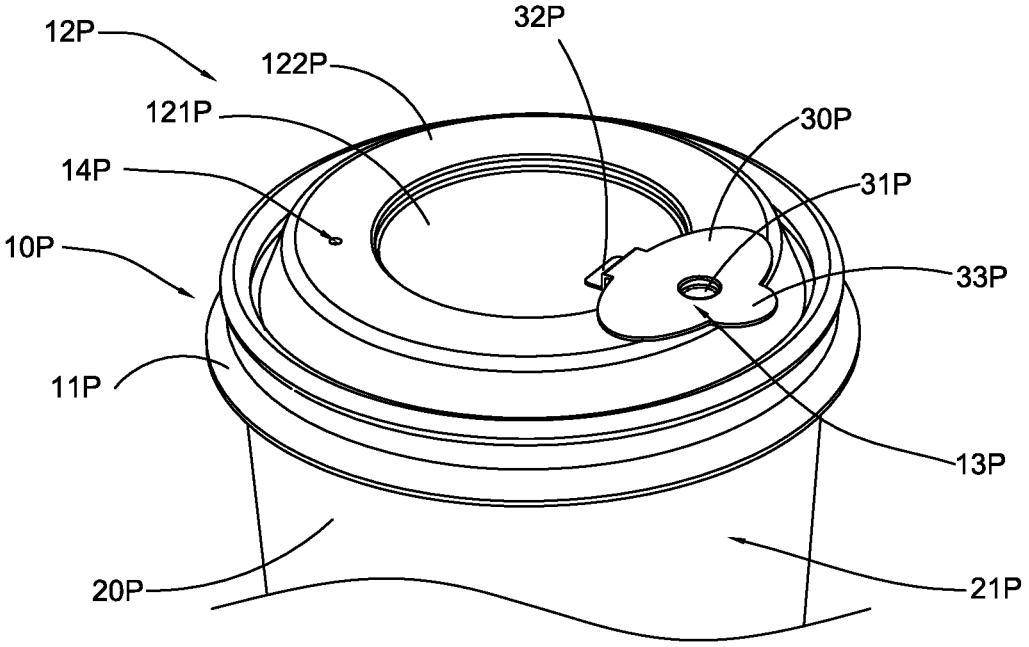
FIG. 40 is a first alternative mode of a container and a container lid according to above eleventh preferred embodiment of the present invention.

Referring to FIG. 40, an alternative of the eleventh preferred embodiment of the present invention is illustrated. The container comprises a protective cover 30P. the protective cover further comprises a sealing member 31P, a fixing member 32P and a operating member 33P, wherein the sealing member 31P is arranged on the surface of the protective cover 30P which has a size and shape that adapted for that of the drinking hole 13P to seal the drinking hole 13P. Preferably, the fixing member is implemented as a plug to be inserted into the drinking hole 13P. the fixing member 32P is provide on one edge of the protective cover 30P to fix the protective cover 30P on the container lid 10P. Preferably, to fix the protective cove 30P on the central zone 121P. The operating member 33P is arranged on the other edge of the protective cover 30P, corresponding with the fixing member 32P. the operating member 33P is formed by extending from the edge of the protective cover 30P outwardly and kept a certain distance from the sealing member 11P. When the customer opens the protective cover 30P, the customer simply operates the operating member 33P. in this preferred embodiment, the operating member is implemented as a handle.

It is worth mentioning that the expansion membrane can be arranged in the fifth and sixth preferred embodiment and their alternates or modifications. In other words, in the fifth and sixth preferred embodiment and their alternates or modifications, the container lid 10E is made of thermal expandable material. When filled with hot drinks, the container lid will expand and form a negative pressure inside the container to present the liquid from spilling out of the container, which makes the container easy and safe to carry.

It is worth mentioning that for the above mentioned embodiments and their alternatives, the sealing edge of the container lid, having an invert U-shape, defines sealing cavity having an enlarged top closed end and an elongated bottom open end for sealing with and receiving the opening edge of the container body at the sealing cavity. In particular, the sealing edge of the container lid comprises an inner wall and an outer wall to define the sealing cavity therebetween. The inner and outer walls are integrally extended at the top sides thereof to define the enlarged top closed end while the bottom sides of the inner and outer walls form the elongated bottom open end. Therefore, when the container lid covers on the top opening of the container body, the opening edge of the container body is sealed at and received in the enlarged top closed end while an upper portion of the container wall is received between the inner and outer walls in a sealedly sandwiched manner. The opening edge of the container body has a thickened configuration to retain a shape of an opening of the container body and to engage with and receive in the sealing cavity. The surface-engagement between the inner wall of the sealing cavity and the outer surface of the container body can be a friction-engagement or adhering-engagement. Therefore, the surface-engagement will enable the container lid to cling to the outer surface of the container body in a sealing manner, to slow down the sliding out movement of the opening edge of the container body from the sealing cavity, and to create more negative pressure inside the container body.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A container, comprising:

a container body having a container cavity; and a container lid detachably coupled at said container body to enclose said container cavity, wherein said container lid has a drinking hole and an expansion membrane for creating a negative pressure within said container body when said container lid is sealed at said container body, wherein said container lid has a central zone and a marginal zone defining said central zone therewithin, wherein said drinking hole is formed at said marginal zone and said expansion membrane is formed at said marginal zone, such that said expansion membrane expands into an expanded space by hot air inside said container cavity to produce said negative pressure.

2. A container, comprising:

a container body having a container cavity;

a container lid detachably coupled at said container body to enclose said container cavity, wherein said container lid has a drinking hole and an expansion membrane for creating a negative pressure within said container body when said container lid is sealed at said container body; and a protective component which comprises a first protective member having a first fixed end extended from said container lid and a first sealed end detachably engaged with said drinking hole to seal said drinking hole for prevent liquid spilling from said container cavity.

3. The container, as recited in claim 2, wherein said container lid further has an air vent, wherein said protective component further comprises a second protective member having a second fixed end extended from said container lid and a second sealed end detachably engaged with said air vent to seal said air vent.

4. The container, as recited in claim 3, wherein at least one of said first fixed end of said first protective member and said second fixed end of said second protective member is rotatably coupled at said container lid.

5. The container, as recited in claim 3, wherein at least one of said first fixed end of said first protective member and said second fixed end of said second protective member is adhered to said container lid.

6. The container, as recited in claim 2, wherein said protective component further has a restraint slot formed at said container lid at a position adjacent to said drinking hole, wherein said first sealed end of said first protective member is selectively engaged with one of said restraint slot and said drinking hole.

7. The container, as recited in claim 2, wherein said first protective member forms a protective cover pivotally coupled at said container lid to selectively cover said drinking hole.

8. A container, comprising:

a container body having a container cavity; and a container lid detachably coupled at said container body to enclose said container cavity, wherein said container lid has a drinking hole and an expansion membrane for creating a negative pressure within said container body when said container lid is sealed at said container body, wherein said container lid has a sealing edge detachably engaged with an opening edge of said container body, wherein said sealing edge of said container lid has a sealing cavity which has an enlarged top closed end and an elongated bottom open end for sealing with and receiving said opening edge of said container body at said sealing cavity, wherein an inner wall of said sealing cavity is surface-engaged with an outer surface of said container body at said opening edge thereof.

9. The container, as recited in claim 8, wherein said opening edge of said container body has a thickened configuration to retain a shape of an opening of said container body and to engage with and receive in said sealing cavity.

10. A lid structure for a container having an opening, comprising:

a container lid for detachably coupled at the opening of the container body to enclose a container cavity thereof, wherein said container lid has a drinking hole and an expandable portion for creating a negative pressure within said container body when said container lid is sealed at said container body, wherein said container lid has a central zone and a marginal zone defining said central zone therewithin, wherein said drinking hole is formed at said marginal zone and said expandable portion is formed at said marginal zone, such that said expandable portion expands into an expanded space by hot air inside the container cavity to produce the negative pressure.

11. The lid structure, as recited in claim 10, wherein said expandable portion is made of thermal expandable material.

12. The lid structure, as recited in claim 10, wherein said expandable portion has a corrugated structure that expands longitudinally or transversely.

13. The lid structure, as recited in claim 10, wherein said expandable portion has a flat structure and is expanded due to heat within the container body.

14. A lid structure for a container having an opening, comprising:

a container lid for detachably coupled at the opening of the container body to enclose a container cavity thereof, wherein said container lid has a drinking hole and an expandable portion for creating a negative pressure within said container body when said container lid is sealed at said container body; and a protective component which comprises a first protective member having a first fixed end extended from said container lid and a first sealed end detachably engaged with said drinking hole to seal said drinking hole for prevent liquid spilling from said container cavity.

15. The lid structure, as recited in claim 14, wherein said container lid further has an air vent, wherein said protective component further comprises a second protective member having a second fixed end extended from said container lid and a second sealed end detachably engaged with said air vent to seal said air vent.

16. The lid structure, as recited in claim 15, wherein said protective component further has a restraint slot formed at said container lid at a position adjacent to said drinking hole, wherein said first sealed end of said first protective member is selectively engaged with one of said restraint slot and said drinking hole.

17. The lid structure, as recited in claim 14, wherein said first protective member forms a protective cover detachably coupled at said container lid to selectively cover said drinking hole.

18. A lid structure for a container having an opening, comprising:

a container lid for detachably coupled at the opening of the container body to enclose a container cavity thereof, wherein said container lid has a drinking hole and an expandable portion for creating a negative pressure within said container body when said container lid is sealed at said container body, wherein said container lid has a sealing edge for detachably engaged with an opening edge of said container body, wherein said sealing edge of said container lid has a sealing cavity which has an enlarged top closed end and an elongated bottom open end for sealing with and receiving said opening edge of said container body at said sealing cavity, wherein an inner wall of said sealing cavity is arranged for surface-engaging with an outer surface of said container body at said opening edge thereof.

* * * * *